United States Patent [19]

Oishi

[11] 4,323,635

[45] Apr. 6, 1982

[54] DIRECT REVERSAL PHOTOGRAPHIC COLOR MATERIAL

[75] Inventor: Yasushi Oishi, Minami-ashigara, Japan

[73] Assignee: Fuji Photo Film Co., Ltd., Kanagawa, Japan

[21] Appl. No.: 204,667

[22] Filed: Nov. 6, 1980

[30] Foreign Application Priority Data

Nov. 6, 1979 [JP] Japan ..... 54-144155

[51] Int. Cl.[3] ..... G03C 5/54

[52] U.S. Cl. ..... 430/217; 430/212; 430/222; 430/223; 430/225; 430/242; 430/505; 430/506

[58] Field of Search ..... 430/505, 506, 217, 222, 430/223, 214, 242, 225

[56] References Cited

U.S. PATENT DOCUMENTS

| | | | |
|---|---|---|---|
| 3,708,300 | 1/1973 | Luckey | 430/505 |
| 3,846,128 | 11/1974 | Thomas et al. | 430/212 |
| 3,930,864 | 1/1976 | Abel | 430/212 |

*Primary Examiner*—Mary F. Downey

*Attorney, Agent, or Firm*—Sughrue, Mion, Zinn, Macpeak & Seas

[57] ABSTRACT

A color photographic material suitable for processing with an alkaline solution in the presence of a developing agent is described, comprising a support and, in sequence, the following five layers:

(1) a first emulsion layer containing an internal latent image forming direct reversal silver halide emulsion that is selectively sensitive to light in a first spectral region;

(2) a first color material layer containing a ballasted dye releasing redox compound that provides a dye image that selectively absorbs light in the first spectral region;

(3) an intermediate layer containing a ballasted reducing agent that captures an oxidized developing agent or electron transfer agent;

(4) a second emulsion layer containing an internal latent image forming direct reversal silver halide emulsion that is selectively sensitive to light in a second spectral region; and

(5) a second color material layer containing a ballasted dye releasing redox compound that provides a dye image that selectively absorbs light in the second spectral region.

The improvement is that a surface latent image forming negative silver halide emulsion that is sensitive to light in the second spectral region is uniformly incorporated in the intermediate layer (3) so as to make uniform the distribution of oxidation of said reducing agent that is formed in the intermediate layer (3) as a result of development of the second emulsion layer.

28 Claims, 6 Drawing Figures

DIRECT REVERSAL PHOTOGRAPHIC COLOR MATERIAL

BACKGROUND OF THE INVENTION

This invention relates to a color photographic material and more particularly to a direct reversal color photographic material useful in color diffusion transfer processes.

Photosensitive materials wherein colored dye image-providing compounds having a ready-made dye structure (i.e., pre-existing chromophiric group) in the molecule are combined with silver halide photosensitive emulsion are known. To avoid speed losses resulting from light absorption, soft gradation and other disadvantages, the following three techniques are commonly used (either solely or jointly): (1) silver halide emulsions and dye image-forming compounds are incorporated in separate layers, in such a manner that three pairs of emulsion layers selectively sensitive to light in different spectral regions and layers containing dye image-providing compounds that selectively absorb light in these different spectral regions are located adjacent thereto, with each emulsion layer positioned closer to the exposing side (that is, the side from which imagewise light exposure is made) of the photosensitive material; (2) intermediate layers are disposed between the three combinations of emulsion layer/layer containing dye image-providing compound; and (3) using an internal latent image-forming silver halide emulsion of direct reversal type and dye releasing redox compound as the dye image-providing compound, respectively. For further details, see *The Theory of the Photographic Process,* T. H. James, Ed., 4th Ed., p. 370 (1977), Macmillan Publishing Co., Inc. Negative emulsions for releasing development inhibitors can be incorporated in the interlayers in a structure as described above, as is taught in German Pat. (DE-AS) No. 2,258,967 (Example 10) and German Pat. (DE-AS) No. 2,516,408 (Example 1).

FIG. 1 shows a color photographic material comprising a support (not shown) having disposed thereon, in the order going from the exposing side (i.e., in sequence, although other layers may also be present):

(1) a first emulsion layer (indicated by 1 in FIG. 1) that contains an internal latent image-forming silver halide reversal emulsion that is selectively sensitive to light in a first spectral region;

(2) a first color material layer (indicated by 2 in FIG. 1) that contains a ballasted compound that provides, upon a redox reaction, a dye image that selectively absorbs light in the first spectral region (said compound being hereinafter referred to as a dye releasing redox compound (also known as a DRR compound));

(3) an intermediate layer (indicated by 3 in FIG. 1) that contains a ballasted reducing agent that captures an oxidized developing agent used as an electron transfer agent;

(4) a second emulsion layer (indicated by 4 in FIG. 1) that contains an internal latent image-forming silver halide reversal emulsion that is selectively sensitive to light in a second spectral region; and (5) a second color material layer (indicated by 5 in FIG. 1) that contains a dye-releasing redox compound that selectively absorbs light in the second spectral region.

The side from which the imagewise light exposure is made is indicated in FIG. 1 by "Exp".

When such photographic material is processed with an aqueous alkaline solution containing a developing agent after imagewise exposure, the following phenomena take place to form an imagewise distribution of dye.

The developing agent coming within these photographic layers develop the first and second emulsion layers so as to provide direct reversal images. The oxidized developing agent migrates to the adjacent first and second color material layers to oxidize the dye releasing redox compounds in these layers. As a result of this cross-oxidation, the diffusable dyes are released and an imagewise distribution of the released diffusable dyes and the remaining dye-releasing redox compounds is formed. If the first color material layer was in direct contact with the second emulsion layer, at least part of the oxidized developing agent coming from the first emulsion layer would pass through the first color material layer and react with the second color material layer. Further, a considerably greater part of the oxidized developing agent coming from the second emulsion layer would react with the first color material layer to release the dye whose light absorption does not correctly correspond to the color sensitivity of the emulsion layer. To provide a correct correspondence between the color sensitive area of emulsion layers and the light-absorbing area of dye images, an intermediate layer containing a reducing agent that is highly reactive to the oxidized developing agent is disposed between the first color material layer and the second emulsion layer. This reducing agent is said to "capture" the oxidized developing agent. In most cases, the first spectral region and the second spectral region are selected from the wavelength regions of from about 400 to 500 nm, and from about 500 to about 600 nm (conventionally a third emulsion layer sensitive to a third spectral region of from about 600 to 700 nm is also employed), according to the principle of color reproduction by the subtractive color process. Therefore, typically suitable emulsion/dye releasing redox compound combinations are selected from the combination of a blue-sensitive emulsion and yellow dye-releasing redox compound, the combination of a green-sensitive emulsion and magenta dye-releasing redox compound, and the combination of a red-sensitive emulsion and cyan dye-releasing redox compound.

However, the color reproduction of a photosensitive material of the structure shown in FIG. 1 is by no means satisfactory even after a proper correspondence of cross-oxidation is assured between the color sensitive area of emulsion layers and the light-absorbing area of dye images. One defect is attributable to the fact that the degree of formation of a dye image from the combination of the first emulsion layer and the first color material layer depends not only on the amount of exposure in the first spectral region but also on the amount of exposure in the second spectral region, i.e., the degree of development of the second emulsion layer. Even if a uniform exposure is achieved in the first spectral region, a large amount of dye tends to be generated from the first color material layer if the second emulsion layer contains a large quantity of developed silver, and a small amount of dye tends to be generated from the first color material if the second emulsion layer contains a small quantity of developed silver. In other words, a large amount of dye is generated in shadow portions of the image, where both the first and second emulsion layers are developed, but at monochromatic portions where only the first emulsion layer is developed, a small amount of dye is generated to give light monochromatic reproduction with a low degree of saturation. In a 3-primary color subtractive color reproducing photographic system comprising three laminated emulsion units sensitive to three spectral regions as noted above, high optical density is obtained in a black portions of the image, where three colors overlap each other, but only low optical density is obtained in monochromatic (yellow or magenta) areas and dichromatic (blue, green, or red) areas, producing a color print which has no sharpness in color and hence requires improvement. Such a defect in color reproduction is referred to as the "negative interimage effect", wherein the development of smulsion layers having different color sensitivities produces mutually intensifying dye images.

Another defect of the photosensitive material of the structure shown in FIG. 1 is poor color reproduction due to reductive deterioration of photographically useful components that is caused by the strong reduction power that the reducing agent in the intermediate layer (interlayer) exhibits under alkaline conditions achieved by development. An example of such deterioration is an irreversible discoloration of an image dye due to reduction.

SUMMARY OF THE INVENTION

One object of this invention is to provide a color photographic material having improved color reproduction quality wherein the negative interimage effect is lessened or eliminated.

Another object of this invention is to provide color diffusion transfer photographic materials and film unit having improved color reproduction qualities wherein the negative interimage effect is lessened or eliminated.

A further object of this invention is to prevent the deterioration of photographically useful components due to the strong reducing power of the interlayer exhibited under alkaline conditions.

It has been found that these objects of this invention can be achieved effectively by a color photographic material of the structure specified below, wherein a negative silver halide emulsion, the color sensitivity of which is substantially the same as that of the second emulsion layer, is incorporated in an intermediate layer that contains a reducing agent capable of capturing the oxidized developing agent.

A color photographic material according to the invention comprises a support, and, in sequence, the following five layers:

(1) a first emulsion layer containing an internal latent image forming direct reversal silver halide emulsion which is selectively sensitive to light in a first spectral region;

(2) a first color material layer containing a ballasted dye releasing redox compound that provides a dye image that selectively absorbs light in the first spectral region;

(3) an intermediate layer that contains a ballasted reducing agent capable of capturing an oxidized developing agent (i.e., electron transfer agent);

(4) a second emulsion layer containing an internal latent image forming direct reversal silver halide emulsion that is selectively sensitive to light in the second spectral region; and (5) a second color material layer that contains a ballasted dye releasing redox compound that provides a dye image that selectively absorb light in the second spectral region, wherein the improvement comprises uniformly incorporating a surface latent image forming negative silver halide emulsion that is sensitive to light in the second spectral region in the intermediate layer (3) so as to obtain uniform oxidation of reducing agent that is formed in the intermediate layer (3) as a result of development of the second emulsion layer.

DETAILED DESCRIPTION OF THE INVENTION

Figure 1:
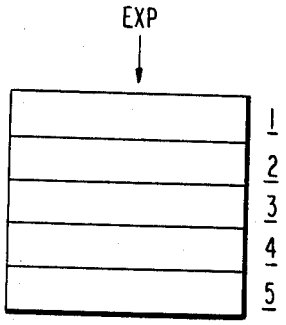
FIG. 1 is a schematic representation of the structure of a photographic material.

As a result of extensive studies, it has been found that the effect of a negative emulsion incorporated in the intermediate layer is to reduce or eliminate negative interimage effect, primarily in that it achieves a uniform distribution of the degree of oxidation of the immobile reducing agent in the intermediate layer upon development. When a photographic material that contains no negative emulsion in the intermediate layer is exposed and developed, an amount of developed silver proportional to the amount of exposure and an oxidized developing agent are formed in the second emulsion layer. The oxidized developing agent diffuses to the adjacent layers and enter into a reaction, i.e., it migrates to the second color material layer and causes a redox reaction with the dye releasing redox compound to form a dye image, and the oxidized developing agent migrating to the intermediate layer oxidizes the reducing agent to provide a distribution therein that is proportional to the degree of development of the second emulsion layer, leaving the reducing agent present in a reverse imagewise distribution. The oxidized developing agent formed upon development of the first emulsion layer migrates to the first color material and initiates a redox reaction with the dye releasing redox compound, and at the same time, it passes through the color material layer to enter the intermediate layer where it reacts with the reducing agent. As a result, the dye releasing redox compound in the first color material layer competes with the reducing agent in the intermediate layer for the oxidized developing agent generated from the first emulsion layer. In order for the intermediate layer to effectively block the migration of the oxidized developer between the emulsion layer units, a reducing agent having high reactivity with the oxidized developer is selected. Therefore, the competition between dye releasing redox compound in the first color material layer and the reducing agent in the intermediate layer has considerably great effect on the redox reaction with the dye releasing redox compounds, irrespective of their positions. As has already been mentioned, the amount of the reducing agent remaining in the intermediate layer is also determined as a function of the amount of development of the second emulsion layer, so the formation of a dye image in the first color material layer is influenced by the development of the second emulsion layer (see FIG. 2A). In a photographic material which contains a negative emulsion in the intermediate layer according to this invention, at least part of the remaining reducing agent is oxidized upon development of the negative emulsion to provide a uniform distribution of the reducing agent in the intermediate layer. It has been found that decreased dependency on the distribution of development of the second emulsion layer puts the dye releasing redox compound in the first color material layer in an advantageous position in its competition with the reducing agent in the intermediate layer for the oxidized developer from the first emulsion layer (see FIG. 2B). The effect of the development of the negative emulsion is exhibited not only on the reducing agent in the intermediate layer but also for providing a uniform distribution in the consumption of the mobile reducing agent in the development processing solution, thus providing another help in lessening negative interimage effect.

Figure 2:
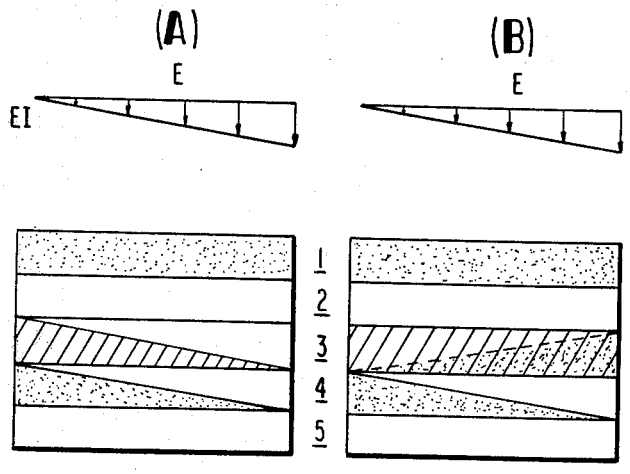
FIG. 2 is a diagram showing the changes that occur in the photographic material of FIG. 1 upon exposure and development.

In FIG. 2, the photographic material of this invention is indicated at B, and the control photographic material is indicated at A. In FIG. 2A and FIG. 2B, E indicates exposure in the second spectral region, EI represents exposure intensity, numbers 1 through 5 have the same meaning as defined in FIG. 1, the hatched area shows a degree of development wherein the reducing agent is oxidized, and the dotted area indicates a degree of oxidized reducing agents wherein the emulsion is developed.

The effect of the negative emulsion within the intermediate layer to lessen negative interimage effect entirely differs from the incorporation of negative emulsion in an interimage layer as described in German Pat. No. 2,258,967 (see Example 10) and German Patent Application (OLS) No. 2,516,408, and therefore it will be understood that such effect is completely unexpected. Comparison is made hereinafter to make the differences between this invention and the above noted techniques clear.

First, it should be noted that the negative emulsion in this invention works in a manner opposite to that used in prior art techniques; in this invention, the negative emulsion in the intermediate layer enhances the dye-image forming reaction (suppresses the competing factor) whereas in the prior art techniques, the emulsion lowers the dye-image forming reaction by suppressing the development of a reversal emulsion (direct reversal silver halide emulsion).

Second, this invention increases or maintains the saturation of a color (particularly, a monochromatic color) during color reproduction, while in the prior art techniques, saturation is believed to decrease. The prior art references claim that the diffusable development inhibitor (halogen ion) originating from the negative emulsion suppresses the development of the reversal emulsion layer, and if this is true, the diffusibility of halogen ion would suppress the development of the reversal emulsion layer in the system to such an extent that the development of a monochromatic area is also inhibited, to achieve low degree of formation of monochromatic images, hence, provide low saturation of monochromes.

Third, a suitably used internal latent image forming emulsion (internal latent image forming silver halide emulsion of direct reversal type) is developed in this invention to a different extent than in the prior art techniques; the development of emulsion in this invention is not substantially suppressed or is even promoted by the halogen ion, but the development of the emulsion in the prior art techniques is supposed to be suppressed considerably by the halogen ion. In fact, although the development of commonly known negative emulsions is inhibited by the halogen ion, the development of most internal latent image forming emulsions is promoted rather than inhibited by the halogen ion, as described in British Pat. Nos. 1,151,363, 1,187,029 and 1,195,837, wherein the halogen ion is iodide ion. Hence, internal latent image forming emulsions the development of which is inhibited by a great extent are a special kind of emulsion. Whether the development of a specific internal latent image forming emulsion is inhibited or not can be easily determined by a routine test method as illustrated by experimental data given hereunder.

Fourth, this invention is also distinguished from the prior art techniques in the arrangement of layers. In this invention, the intermediate layer is in substantial contact with the second emulsion layer without a redox reaction derived barrier, and the oxidizing power of the second reversal emulsion and the negative emulsion is made uniform by means of the intermediate layer. In the prior art techniques, the layer that contains a negative emulsion layer for releasing a development inhibitor is separated from other emulsion layers by two reducing agent containing layers placed on both sides thereof and is independent of redox reaction.

Fifth, it is required in the prior art techniques that a relatively large amount of negative emulsion be incorporated in the intermediate layer so that the halogen ion released inhibits the development of the internal latent image forming emulsion, whereas this invention requires a relatively small amount of the negative emulsion, which is sufficient for providing uniform distribution of the consumption of the reducing agent in the intermediate layer. More specifically, for development inhibition in the prior art, the coating weight of silver in the negative emulsion is suitably at least 25% of silver in the adjacent direct reversal emulsion, whereas for reducing negative interimage effect in this invention, a suitable amount is not more than 20%.

By incorporating a negative emulsion in the intermediate layer, the undesired strong reducing action the reducing agent has on other useful components under alkaline conditions can be lessened. The strong reducing activity of the reducing agent incorporated in the intermediate layer is necessary for capturing the oxidized developing agent but it may deteriorate and inhibit the function of other useful components which are relatively easily reduced. As is well known, the reducing activity of a reducing agent is expressed by redox potential and varies with the ratio of (reduced form)-/(oxidized form) which is high when the reducing activity is strong. By incorporating the negative emulsion in the intermediate layer, the ratio of (reduced form)-/(oxidized form) at highlights which are subjected to high degree of exposure and oxidized to a small extent with the second emulsion layer can be adjusted to a range where the deterioration of useful components does not easily take place. As will be readily understood, this adjustment is made with particular advantage by a negative emulsion that provides an imagewise distribution which is the reverse of the imagewise distribution formed by the image-forming reversal emulsion. This is because if the adjustment is achieved uniformly over the entire surface area, the capacity of capturing the oxidized developer is decreased by the ratio of oxidation. The degree of oxidation of the reducing agent in the intermediate layer at highlights by the negative emulsion to prevent the deterioration of useful components varies with the type of reducing agent, the type of useful components the deterioration of which should be prevented, and the developing conditions, and a preferred intermediate layer contains a negative silver halide emulsion that contains from about 0.04 to 0.8 redox equivalents, and preferably from 0.1 to 0.6 equivalents, of silver per equivalent of reducing agent. For protecting the easily reducible useful components from deterioration, it is effective to mix the silver halide grains of the negative emulsion with the reducing agent substantially uniformly. For preventing the reductive deterioration of a cyan dye, it is advantageous to incorporate a green-sensitive negative emulsion in the intermediate layer adjacent to the green-sensitive reversal emulsion layer.

In a preferred color photographic material of this invention, the following photographic layers are arranged on a support, in sequence (i.e., in order going from the exposing side (that is, the side from which the imagewise exposure is intended to be made)): (1) a blue-sensitive internal latent image forming direct reversal silver halide emulsion layer; (2) a layer that contains a yellow dye releasing redox compound; (3) a first intermediate layer that contains a ballasted reducing agent capable of capturing an oxidized developing agent (i.e., electron transfer agent); (4) a green-sensitive internal latent image forming direct reversal silver halide emulsion layer; (5) a layer that contains a magenta dye releasing redox compound; (6) a second intermediate layer that contains a ballasted reducing agent capable of capturing an oxidized developing agent (i.e., electron transfer agent); (7) a red-sensitive internal latent image forming direct reversal silver halide emulsion layer; and (8) a layer that contains a cyan dye releasing redox compound. Preferably, either one of the first and second intermediate layers, and more preferably, both of them contain a negative emulsion. The negative emulsion in the first intermediate layer is optically sensitized as green-sensitive, and that in the second intermediate layer is optically sensitized as red-sensitive.

In another preferred embodiment of this invention, a diffusion transfer photographic material may be composed by combining the above-described photographic material with an image-receiving layer that contains a polymer for receiving and immobilizing a diffusable dye released from the dye releasing redox compounds. In this preferred embodiment, it is advantageous to make a diffusion transfer photographic film unit wherein the above defined photographic layers are arranged between the already mentioned support and another support, and a container for processing solution is provided so that an aqueous alkaline solution containing a developing agent (i.e., electron transfer agent) can be supplied in a laminar form to the right position between the two supports after picture taking and exposure. The diffusion transfer photographic film unit advantageously has a neutralizing layer that contains a polymer acid and which is placed in contact with either one of the supports. The neutralizing layer neutralizes or renders weakly acidic the alkali brought between the supports by the processing solution after development and dye transfer have completed substantially. For making a color print that provides good image quality over a wide range of processing temperatures, it is particularly advantageous to separate the neutralizing layer from the photographic layers under development by a neutralization delaying layer (neutralization timing layer) that provides a neutralization timing which is determined by the temperature dependency of the process of development and dye transfer.

The color photographic material of this invention is less susceptible to negative interimage effect and is more capable of reproducing a sharp color than conventional materials. Particularly, the material of this invention is capable of providing a dye image that maintains high optical density and reproduces colors of high saturation even when the dye image is formed in only one spectral region. For a three-color system, monochromatic areas such as yellow, magenta and cyan can reproduce sharp colors by maintenance of an optical density as high as the level in black areas. These advantages can also be obtained in dichromatic areas such as red, green and blue.

The color photographic material of this invention can realize a tone reproduction in monochromatic or dichromatic gradation areas that is substantially equal to the respective densities in gray gradation areas. There is only a small increase in the apparent sensitivity of monochromatic or dichromatic records as compared with the gray scale areas. The resulting advantage is a faithful record of light colors without color skipping.

Another advantage of the color photographic material of this invention is that it is less susceptible to the attack of the strong reducing agent in the intermediate layer, because of the small quantity of the residual reducing agent. Therefore, poor color reproduction wherein a reducing agent activated in a highly alkaline medium reduces an image dye to cause a change in color can be effectively prevented by this invention. Such effect is particularly great with dyes that contain the following nitroaryl groups or nitro-substituted heterocyclic groups as a structural element.

(i) dyes having 2- or 4-nitrophenylazo group: particularly, dye groups derived from 4-(4-nitrophenylazo)-phenol, such as

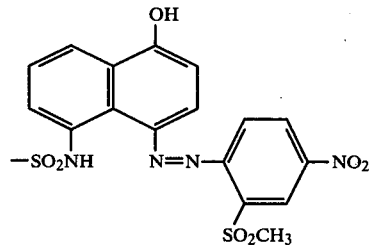

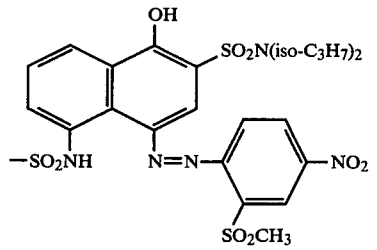

and dye groups derived from N,N-di-substituted-4-(2- or 4-nitrophenylazo)aniline, such as

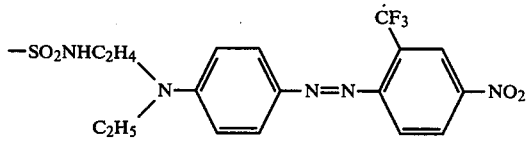

(ii) dyes having nitro-substituted heterocyclic azo group, such as

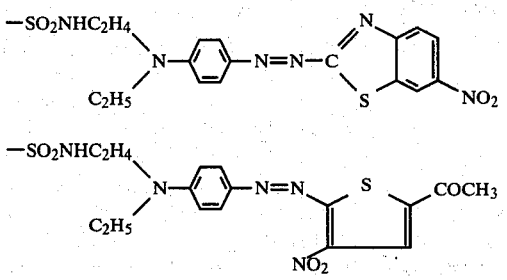

The emulsion layer used in this invention contains an internal latent image forming direct reversal silver halide emulsion and a nucleus forming agent, and upon processing with an aqueous alkaline solution containing a developing agent, it provides a reverse (positive) silver image according to the principles of the internalimage reversal process described in T. H. James, *The Theory of the Photographic Process,* 4th Ed., p. 187. The distribution of the silver development is converted to the distribution of dye image by means of a redox reaction.

The internal latent image forming direct reversal silver halide emulsion used in this invention has a sensitivity center primarily within the silver halide emulsion grains, and upon exposure it selectively forms a latent image in that center, while the degree of formation of a latent image on the surface of the grains is low. Such an internal latent image forming silver halide emulsion (internal latent image forming direct reversal silver halide emulsion) is characterized by the fact that the amount of silver in an image (corresponding to a surface latent image) obtained by development, after exposure, with a surface developer according to the description in T. H. James, loc. cit., at pp. 171 to 179, is appreciably smaller than that of silver in an image (corresponding to a total latent image) obtained by an internal developer. The internal latent image forming silver halide emulsion can be prepared by various methods, and among the applicable emulsions are: a Burton's emulsion of high iodine content which is prepared by the ammoniacal method (E. J. Wall, *Photographic Emulsions,* pp. 35–36, 52–53, American Photographic Publishing Co., (1929) and U.S. Pat. Nos. 2,497,875 and 2,563,785); a primitive emulsion of low iodine content which comprises large grains and is prepared by the ammoniacal method (German Patent Application (OLS) No. 2,728,108); an emulsion prepared by suddenly reducing the concentration of ammonia in a silver halide/ammonia complex salt solution to precipitate silver halide grains (U.S. Pat. No. 3,511,662); a conversion emulsion prepared by the catastrophy precipitation method wherein grains of silver salt of high solubility such as silver chloride are first formed and then converted to a silver salt of low solubility such as silver iodobromide (U.S. Pat. No. 2,592,250); a core-shell emulsion comprising large grains of a chemically sensitized core emulsion which is covered with a shell of fine silver halide emulsion grains formed by ripening a mixture of two types of emulsion (U.S. Pat. No. 3,206,313 and British Pat. No. 1,011,062); a core-shell emulsion comprising chemically sensitized monodisperse core emulsion grains which are covered with a shell of silver halide formed by adding to the core emulsion both a soluble silver salt solution and a soluble halide salt solution simultaneously at a constant silver ion concentration (British Pat. No. 1,027,146 and U.S. Pat. No. 3,761,276); a halogen localized emulsion whose grains are of laminated structure having two or more phases wherein the first phase has a different halide formulation than that of the second phase (U.S. Pat. No. 3,935,014); and an emulsion having dissimilar metals incorporated therein by forming silver halide grains in an acidic medium that contains trivalent metal ions (U.S. Pat. No. 3,447,927).

Internal latent image forming emulsions used with advantage in this invention have a halide formulation wherein bromide content is at least 90 mol%, chloride content is from 0 to 10 mol%, and iodide content is from 0 to 5 mol%. Particularly advantageous emulsions are such that the grain surface (shell) has a halide formulation wherein bromide content is at least 95 mol%, chloride content is from 0 to 5 mol%, and iodide content is from 0 to 1 mol%.

The internal latent image forming emulsions identified above are optically sensitized for predetermined spectral regions with sensitizing dyes such as cyanine dye or merocyanine dye, or mixtures thereof or combinations of these sensitizing dyes with supersensitizers by the conventional methods described in T. H. James, loc. cit., at chaps. 8–10, pp. 194–290. Examples of the combination of sensitizing dyes particularly suitable for the optical sensitization of the internal latent image forming emulsion of this invention are described in Japanese Patent Application (OPI) Nos. 14819/76 (the term "OPI" as used herein refers to a "published unexamined Japanese patent application"), 135528/76, 9522/78, 10423/78, 71829/78 and 16223/77.

One reversal emulsion layer in the color photographic material of this invention contains an internal latent image forming emulsion equivalent to from 0.3 to 2.5 g/m$^2$, and preferably from 0.5 to 2.0 g/m$^2$, of silver.

The reversal emulsion layer of this invention provides a silver reverse image (positive image) by being developed in the presence of a nucleus forming agent that injects electrons into silver halide grains during development. The nucleus forming agent may be incorporated in the developer, but it is advantageous for the implementation of this invention to incorporate the agent in the silver halide emulsion layer. Suitable nucleus forming agents are hydrazines and their derivatives as described in East German Pat. No. 5,024, U.S. Pat. Nos. 2,563,785, 2,588,982, 2,604,440, 3,227,552, 4,030,925, 4,080,207, British Pat. No. 2,102,443A, *Research Disclosure,* Item No. 15164, p. 76–77 (structural formulae I and II), and heterocyclic quaternary ammonium compounds as described in U.S. Pat. Nos. 3,615,615, 3,718,470, 3,719,494, 3,734,738, 3,330,655, 4,094,683 and Japanese Patent Applicatio No. 46949/79 (corresponding to U.S. Ser. No. 140,923, filed on Apr. 16, 1980). For promoting development, the reversal emulsion layer advantageously contains not more than 0.2 mol, per mol of silver, of a sulfoalkylhydroquinone, e.g., a potassium salt of 2-octadecyl-5-sulfohydroquinone, as descried in U.S. Pat. No. 3,227,552.

The intermediate layer used in this invention contains a ballasted reducing agent that captures an oxidized developing agent and a negative emulsion. The negative silver halide emulsion that is used in this invention can be selected from among conventional well known negative emulsions of the type that form a latent image on the surface of the grains (surface latent image forming emulsion). Specific examples of such emulsion are described in P. Glafkides, *Chimie et Physique Photographiques,* 3rd Ed., Chap. 19, pp. 365–370, Publications Photocinema Paul Montel, Paris, (1967). Negative emulsions advantageous for the practice of this invention have a halide formulation wherein bromide content is at least 90 mol%, chloride content is from 0 to 10 mol%, and iodide content is from 0 to 10 mol%, and have an average grain size of from 0.1 to 1.5 microns. The surface of the emulsion grains is subjected to sulfur sensitization, gold sensitization, reduction sensitization and mixed chemical sensitization in compliance with the description in T. H. James, loc. cit., Chap. 5, pp. 149–169. Upon exposure, a latent image is formed on the grain surface. To provide a color sensitivity substantially the same as that of the adjacent reversal emulsion layer, the negative emulsion is optically sensitized with sensitizing dyes, mixtures thereof or their combination with supersensitizers by the conventional methods described in T. H. James, loc. cit., at Chaps. 8–10, pp. 194–290. The negative emulsion incorporated in the intermediate layer is desirably stabilized with anti-foggants of the type described in P. Glafkides, loc. cit., at pp. 408–416. Preferred anti-foggants include mercapto compounds such as 1-phenyl-5-mercaptotetrazole and benzotriazole derivatives such as 5-(3-methyl-2-benzothiazolidene)-aminobenzotriazole. However, the negative emulsion is substantially free of a substance that releases a development inhibitor.

The negative emulsion incorporated in the intermediate layer has an optical density substantially equal to that of the adjacent reversal emulsion to be combined therewith. This is suitable for the purpose of lessening negative interimage effect by providing a uniform distribution of the oxidation of the reducing agent in the intermediate layer and for avoiding the increase in the capacity of capturing an oxidized developing agent in the intermediate layer. To be more specific, it is advantageous to control the optical density of the negative emulsion in such a manner that the gradation areas of normalized characteristic curves of the amount of silver developed in a combination of reversal emulsion layer and intermediate layer of a photosensitive material developed under predetermined conditions (curves that plot, as a function of the logarithm of exposure, the amount of developed silver normalized for the maximum amounts of silver in the respective layers) overlap substantially crosswise, and that the middle points of the amounts of silver on the normalized characteristic curves are separated from each other by a distance not greater than 0.6, preferably not greater than 0.3, along the logarithmic axis (for amount of exposure).

The amount of the negative emulsion to be incorporated in the intermediate layer depends on the type and quantity of the reducing agent used in combination with the emulsion, the performance of the reversal emulsion, the additives in the emulsion layer, the properties of the dye releasing redox compounds used, etc., and it can be determined by a routine test. Suitably, the intermediate lyaer contains a negative silver halide emulsion that contains silver from about 0.02 to about 0.2 time, preferably from 0.05 to 0.15 time greater the coating weight of silver in the reversal emulsion layer to be combined with the negative emulsion.

The ballasted reducing agent used in the intermediate layer of this invention can be selected from a wide variety of compounds that have the ability to capture an oxidized developing agent (i.e., electron transfer agent) upon cross-oxidation with said oxidized developer. To make these compounds immobile within the intermediate layer under alkali conditions used during development, they must be ballasted with at least one hydrophobic residual group such as alkyl or aralkyl group having at least 10 carbon atoms in total. Details of the hydrophobic residual group used as a ballast group will be given hereunder. The reducing group is substituted by a ballast group either directly or through a linking group. Examples of the reducing group used with advantage in this invention include 1,2- or 1,4-dihydroxyphenyl group, 2- or 4-aminophenol group and groups derived from 2- or 4-sulfonamide phenol.

Examples of the ballasted reducing agent used in this invention include the dihydroxybenzene derivatives described in U.S. Pat. Nos. 2,336,327, 2,360,290, 2,403,721, 3,700,453, 2,701,197, Japanese Patent Application (OPI) Nos. 2128/71, 29637/79 and 9528/78, 2,5-disulfonamide phenols described in *Research Disclosure,* 18, 143, and the N-alkyl- or N-arylbenzoisoxazolones described in *Research Disclosure,* 18, 144. The reducing agent may be incorporated in the intermediate layer in the form of a precursor wherein the hydroxyl group or amino group in the reducing group is blocked with a hydrolyzable acryl group or the like. The reducing group may be substituted by groups other than the ballast group such as alkyl group, aryl group, alkoxy group, aryloxy group, alkylthio group, acylamino group, sulfonamido group, and sulfo group.

Compounds of the formula (I) below are preferred as the reducing agent to be used in this invention:

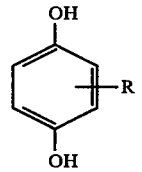

(I)

wherein R is an alkyl group (e.g., methyl, tert-butyl, octyl, tertoctyl, dodecyl or octadecyl), aryl group (e.g., phenyl), alkoxy group (e.g., methoxy, butoxy, or dodecyloxy), aryloxy group (e.g., phenoxy) carbamoyl group (e.g., methylcarbamoyl, dibutylcarbamoyl, octadecylcarbamoyl, or phenylcarbamoyl), sulfamoyl group (e.g., methylsulfamoyl or octadecylsulfamoyl), acyl group (e.g., lauroyl), alkoxycarbonyl group (e.g., methoxycarbonyl or dodecyloxycarbonyl), sulfo group or aryloxycarbonyl group (e.g., phenyloxycarbonyl), the alkyl and aryl in these groups may have a substituent such as a halogen atom, alkyl group, aryl group, alkoxy group, aryloxy group, carboxy group, alkoxycarbonyl group, aryloxycarbonyl group, acyl group, acyloxy group, carbamoyl group, sulfo group, sulfamoyl group, sulfonamido group, N-alkylamino group, N-arylamino group, acylamino group, imido group or hydroxy group, and one to three of the reamining three hydrogen atoms on the aromatic nucleus of hydroquinone may be substituted by one to three of the groups defined for R (said one to three substituents may be the same or different). The substituents on the benzene ring of formula (I) have a total of from 8 to 40, and preferably from 15 to 36, carbon atoms.

Specific examples of reducing agents that can be used with advantage in this invention are listed below:

(R-1)
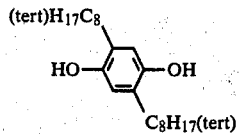
(R-2)
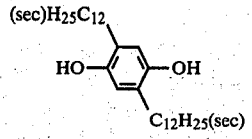
(R-3)
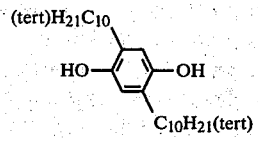
(R-4)
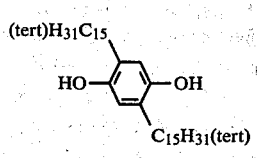
(R-5)
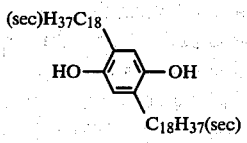
(R-6)
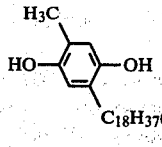
(R-7)
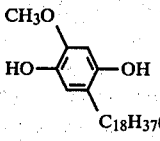
(R-8)
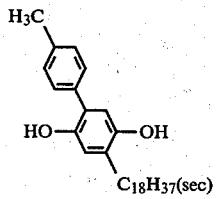
(R-9)
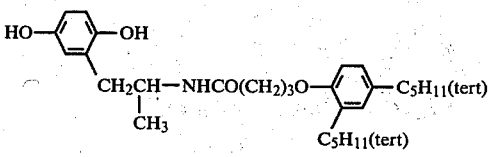
(R-10)
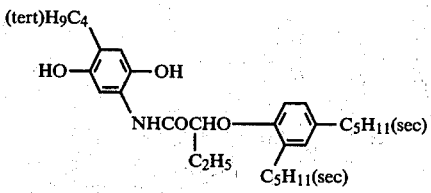
-continued
(R-11)
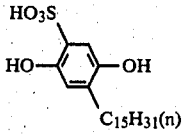
(R-12)
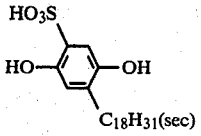
(R-13)
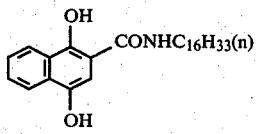
(R-14)
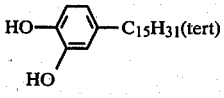
(R-15)
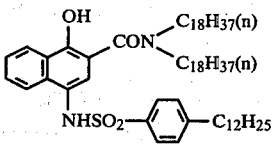
(R-16)
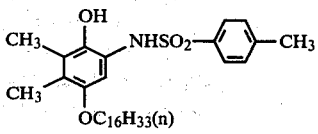
(R-17)
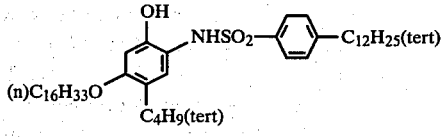
(R-18)
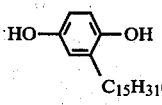
(R-19)
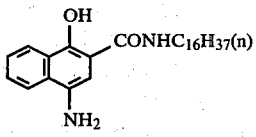
(R-20)
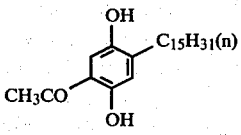
(R-21)
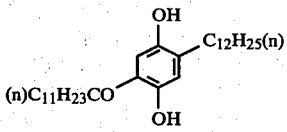
These reducing agents can be incorporated in a micellar form in a suitable hydrophilic polymer binder (such as gelatin) as a colloidal suspension or colloidal emulsion. When incorporated as an emulsion, the reducing agents can be dispersed together with a high boiling solvent such as di-n-butyl phthalate, tri-o-cresyl phosphate, N,N-diethyllaurylamide, and tricyclohexyl phosphate or a polymer as described in Japanese Patent Application No. 52113/79 (corresponding to U.S. Ser. No. 143,232, filed on Apr. 24, 1980). The weight ratio of the reducing agent to hydrophilic polymer binder is preferably in the range of from about 0.2/1 to 5/1, and more preferably from 0.3/1 to 2/1.

The suitable amount of the reducing agent incorporated in the intermediate layer according to this invention is from about 0.15 to 0.5, especially from 0.2 to 0.4, redox equivalents per equivalent of silver halide in the adjacent emulsion layer (i.e., the second emulsion layer). What redox equivalent corresponds to 1 mol of the reducing agent varies with the developing conditions. Under strong alkali conditions wherein the pH is higher than about 12, hydroquinones which are easily hydroxylated on the nucleus, say, Compound (R-18) mentioned above acts as if 1 mol were 4 equivalents, but most of the other compounds, say, 2,5-dialkylhydroquinones act as if 1 mol were 2 equivalents. The number of equivalents of a specific reducing agent can be determined by a routine test.

In one preferred embodiment of this invention, a spacer layer made of hydrophilic polymer, such as gelatin, having a dry thickness of about 0.05 to about 5 microns, preferably from 0.1 to 1 micron is interposed between the first color material layer and the intermediate layer as described in Japanese Patent Application No. 125600/78 (corresponding to U.S. Ser. No. 83,706, filed Oct. 11, 1979). A ballasted reducing agent may be incorporated in the spacer layer in an amount of less than 0.1 equivalent of the reducing agent in the intermediate layer. The spacer layer is capable of preventing the migration of the dye releasing redox compound and the ballasted reducing agent between the adjacent intermediate layer and color material layer. The spacer layer prevents the negative emulsion grains in the intermediate layer from contacting directly the dye releasing redox compound in the color material layer and can prevent the increase in $D_{min}$ depending upon the development conditions.

The developing agent used in this invention develops a silver halide emulsion under alkaline conditions and the resulting oxidized developing agent has an electron transfer property (stabilizing and oxidizing properties) by which it migrates to the adjacent color material layer and cross-oxidizes the dye releasing redox compound. The suitable developing agent varies with the silver halide emulsion, dye releasing redox compound, developing conditions (particularly alkali concentration), the reducing agent in the intermediate layer, etc., and it can be selected from among the compounds described in T. H. James, loc. cit., at Chap. 11, pp. 291–334 which are conventionally known as developing agents. Particularly advantageous developing agents are N-substituted-p-phenylenediamines, N-substituted-p-aminophenols and 1-substituted-3-pyrazolidinones. Particularly preferred developing agents are 1-aryl-3-pyrazolidinones of the formula indicated below:

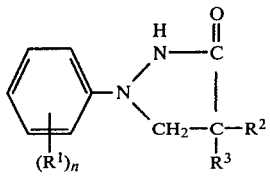

(II)

wherein n is an integer of 0 to 5, preferably 0, 1 and 2; $R^1$ is selected from a halogen atom (e.g., fluorine, chlorine or bromine), alkyl group (having 1 to 8 carbon atoms, such as methyl or ethyl), alkylthio group (wherein the alkyl has 1 to 8 carbon atoms), alkoxy group (wherein the alkyl has 1 to 8 carbon atoms, such as methoxy or ethoxy), aryl group (having 6 to 10 carbon atoms, such as phenyl), aryloxy group (wherein the aryl has 6 to 10 carbon atoms), arylthio group (wherein the aryl has 6 to 10 carbon atoms), acylamino group (wherein the acyl has 2 to 9 carbon atoms), carbamoyl group, sulfonylamino group (the alkyl in the alkyl-$SO_2NH$ group has 1 to 8 carbon atoms), sulfamoyl group (the alkyl in the alkyl-$NHSO_2$- has 1 to 8 carbon atoms) and cyano group; when n is 2 or more, 2 or more $R^1$s may be the same or different and two adjacent $R^1$s may form a condensed carbon ring; the total of carbons included in $(R^1)_n$ does not exceed 12; $R^2$ and $R^3$ are selected from a hydrogen atom and alkyl group (wherein the alkyl has 1 to 8 carbon atoms and may be substituted by hydroxyl group or alkoxy group); the total of carbons included in $R^2$ and $R^3$ does not exceed 12.

The compounds of the formual (II) which have the chemical reducibility expressed by a polarographic half wave potential of from about −80 mV to about −200 mV on a saturated calomel electrode at a pH of 11.0 are particularly advantageous for this invention.

Illustrative developing agents that can be used with advantage in this invention are listed below. These developing agents can be used alone or as a mixture.

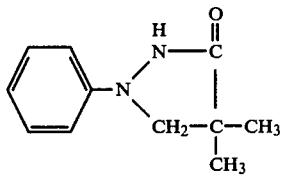

(D-1)

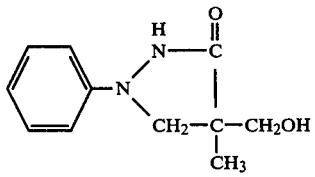

(D-2)

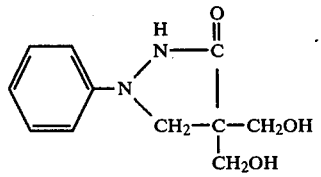

(D-3)

-continued (D-4)

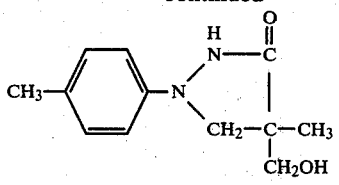

(D-5)

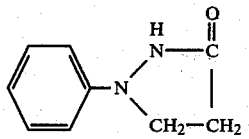

(D-6)

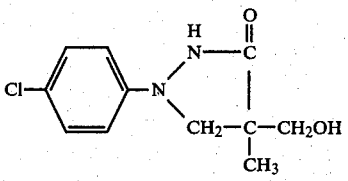

(D-7)

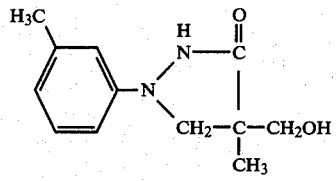

(D-8)

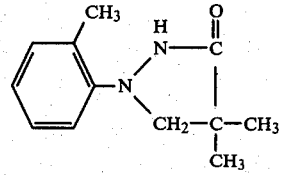

(D-9)

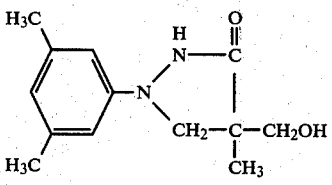

(D-10)

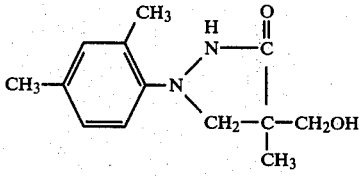

(D-11)

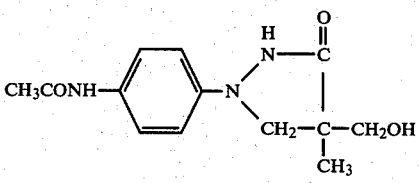

(D-12)

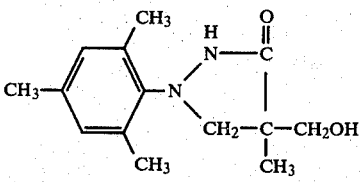

Other suitable developing agents are identified below:

(D-13)

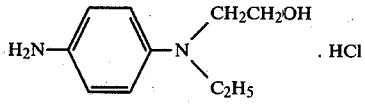

(D-14)

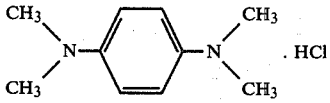

(D-15)

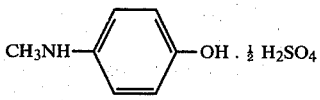

The developing agent used in this invention is preferably incorporated in an alkaline processing solution, but it may be incorporated in the color photosensitive material.

The developing agent used in this invention is a kind of surface developer which does not contain a compound, such as thiocyanate salt, thiosulfate salt, thioether or hydantoin, that exhibits strong ability to dissolve silver halide grains and which does not substantially develop a latent image within the emulsion particles.

The dye releasing redox compound used in this invention is made non-diffusable with a ballast group so that it does not move about in a photographic layer under developing conditions, and as a result of cross-oxidation with the oxidized developing agent, the compound releases a mobile dye in the form of an imagewise distribution to provide a dye image. The dye releasing redox compound used to advantage in this invention is a redox compound of the type which undergoes, only after it is cross-oxidized, the reaction of cleaving the bond that links the dye group or dye precursor group with the ballast group. Such redox compound is schematically represented by the following formula:

(Ballast)—(Link)—(Dye) (III)

wherein (Ballast) is a ballast group that makes the dye releasing redox compound non-diffusable, and is selected from among the groups described hereunder: (Dye) is a dye group that provides a dye or dye precursor capable of moving about in an alkaline medium; and (Link) is a redox cleavable bond containing a bond that is cleaved upon cross-oxidation with an oxidized developing agent.

Examples of the (Ballast)—(Link)—group used in this invention are described in T. H. James, loc. cit., at pp. 369–372, and specific examples thereof are given in U.S. Pat. Nos. 3,728,113, 3,928,317, 3,993,638, 4,076,529, 3,443,940, 3,751,406, 3,698,897, 3,725,062, 4,135,929 and 4,110,113, German Patent Application (OLS) No. 2,534,424, U.S. Pat. No. 4,053,312, British Pat. No. 1,546,103, German Patent Application (OLS) No. 2,645,656, U.S. Pat. No. 4,055,428, Japanese Patent Application Nos. 91187/79 (corresponding to U.S. Ser. No. 170,261, filed July 18, 1980), U.S. Pat. No. 4,149,892 and *Research Disclosure, Nos.* 17,443, 18,024, 15,157 and 17,842. Particularly advantageous examples are listed below:

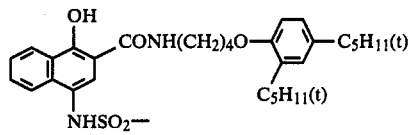

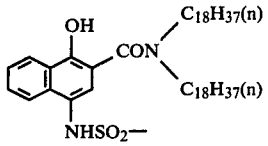

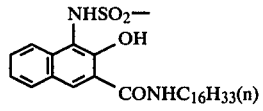

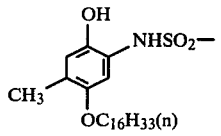

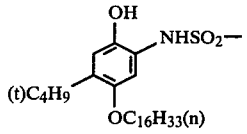

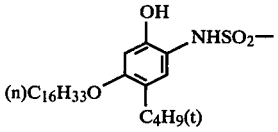

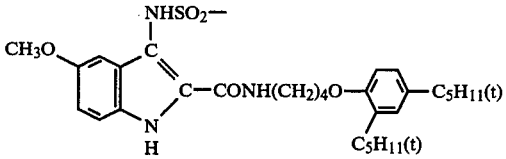

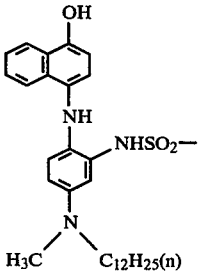

The ballast group in the residual groups illustrated above can be easily replaced by other ballast groups. Other applicable dye image providing compounds are dye releasing redox compounds of the type which lose the ability to release a dye when oxidized and are able to release a dye only when they are in a reduced form, and examples of such compound are described in British Pat. No. 1,542,308, U.S. Pat. Nos. 3,980,479 and 4,108,850, and Japanese Patent Application (OPI) No. 69033/78.

The (Dye) group in the formula (III) is a residual group derived from dyes such as metal chelate dyes, e.g., azo dye, azomethine dye, anthraquinone dye, and phthalocyanine dye, and precursors thereof. Examples of the dye group that can be incorporated in the dye releasing redox compound used in this invention are described in *The Chemistry of Synthetic Dyes,* ed. by K. Venkataraman, Vol. 8, pp. 331–387, Academic Press, (1978), U.S. Pat. Nos. 3,309,199, 4,013,633, German Patent Application (OLS) No. 2,906,526, Japanese Patent Application (OPI) No. 114930/76, U.S. Pat. Nos. 3,705,184, 4,156,609 and 4,139,383, German Patent Application (OLS) No. 2,733,112, U.S. Pat. Nos. 3,765,886, 3,453,107, and 3,544,545, Japanese Patent Application (OPI) No. 106727/77, U.S. Pat. Nos. 3,932,380 and 3,954,476, German Patent Application (OLS) No. 2,847,371, Japanese Patent Application (OPI) No. 23628/78, Japanese Patent Application (OPI) Nos. 36804/80, 161332/79 and 4028/80, Japanese Patent Application (OPI) No. 48533/79, U.S. Pat. Nos. 3,135,606, and 3,209,016, German Patent Application (OLS) No. 2,634,730, U.S. Pat. No. 3,857,855, British Pat. No. 1,551,138, U.S. Pat. Nos. 3,929,760, 3,942,987 and 4,013,635, German Patent Application (OLS) No. 2,823,903, Japanese Patent Publication Nos. 47823/78 and 143323/78, and German Patent Application (OLS) Nos. 2,652,316 and 2,806,196. The dye releasing redox compound used in this invention may have incorporated therein an acylated dye group the light absorption of which is shifted temporarily when it is incorporated in the photosensitive material, as taught in U.S. Pat. Nos. 3,336,287, 3,579,334, and 3,982,946, and British Pat. No. 1,467,317. An azo dye having a nitroaryl group is particularly advantageous for use in this invention because of its stability.

The ballast group is an organic ballast group that is capable of keeping the dye releasing redox compound non-diffusable even when it is developed in an alkaline processing solution, and the ballast group preferably contains a hydrophobic group having from 8 to 32 carbon atoms. Such organic ballast group is connected to the dye releasing redox compound either directly or through a linking group (e.g., imino bond, ether bond, thioether bond, carbonamido bond, sulfonamido bond, ureido bond, ester bond, imido bond, carbamoyl bond and sulfamoyl bond which may be present independently or in combination).

Specific examples of ballast groups are illustrated below: alkyl and alkenyl group (e.g., dodecyl group or octadecyl group); alkoxyalkyl group (e.g., 3-(octyloxy)-propyl group or 3-(2-ethylundecyloxy)propyl group as described in Japanese Patent Publication No. 27563/64); alkylaryl group (e.g., 4-nonylphenyl group or 2,4-di-tert-butylphenyl group); alkylaryloxyalkyl group (e.g., 2,4-di-tert-pentylphenoxymethyl group, α-(2,4-tert-pentylphenoxy)propyl group, 1-(3-pentadecylphenoxy)ethyl group); acylamidoalkyl group (e.g., groups as described in U.S. Pat. Nos. 3,337,344 and 3,418,129, or 2-(N-butyl-hexadecanamido)ethyl group); alkoxyaryl and aryloxyaryl groups (e.g., 4-(n-octadecyloxy)phenyl group or 4-(4-n-dodecylphenyloxy)phenyl group); a residual group having both a long-chain aliphatic group such as alkyl or alkenyl and a group that renders the dye releasing redox compound water-soluble such as carboxyl or sulfo group (e.g., 1-carboxymethyl-2-nonanedecenyl group or 1-sulfoheptadecyl group); ester-substituted alkyl group (e.g., 1-ethoxy-carbonylheptadecyl group or 2-(n-dodecyloxycarbonyl)ethyl group); alkyl group substituted by aryl group or heterocyclic group (e.g., 2-[4-(3-methoxycarbonyluneicosaneamido)phenyl]ethyl group or 2-[4-(2-n-octadecylsuccinimido)phenyl]ethyl group); and aryl group substituted by aryloxyalkoxycarbonyl group (e.g., 4-[2-(2,4-di-tert-pentylphenyloxy)-2-methylpropioxycarbonyl]phenyl group).

Particularly preferred organic ballast groups are those which are connected with a linking group as represented by the following formulae:

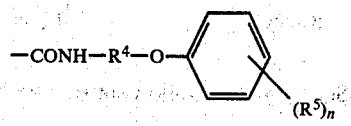

$$-CONH-R^4-O-C_6H_4-(R^5)_n$$

$$-CONH-R^4-O-R^6$$

$$-O-R^7$$

$$-CONHR^6$$

wherein $R^4$ is an alkylene group having from 1 to 10, and preferably from 1 to 6, carbon atoms, such as a propylene group or butylene group; $R^5$ is a hydrogen atom or an alkyl group having from 1 to 10, preferably from 1 to 6, carbon atoms, such as tert-amyl group; n is an integer of from 1 to 5 (preferably 1 or 2); $R^6$ is an alkyl group having from 4 to 30 carbon atoms, preferably from 10 to 20 carbon atoms, such as dodecyl group, tetradecyl group or hexadecyl group; $R^7$ is an alkyl group having from 8 to 30, and preferably from 10 to 20, carbon atoms (e.g., hexadecyl group or octadecyl group) or a substituted alkyl group having a total of 8 carbon atoms or more (wherein the alkyl residue has at least one carbon atoms, and an example of the substituent is carbamoyl).

The photosensitive material of this invention can be applied to color diffusion transfer photography in the form of a peel-apart film unit or an integrated film unit as described in U.S. Pat. Nos. 3,415,645, 3,415,646 and 3,594,164, British Pat. No. 1,330,524, and U.S. Pat. No. 3,993,486. When formulated as an integrated film unit, the photosensitive material of this invention advantageously has a layer of polymer acid that is protected with a neutralization delaying layer that provides a shorter neutralization timing period with time as described in U.S. Pat. No. 4,056,394, German Patent Application (OLS) Nos. 2,754,514 and 2,852,130, Japanese Patent Application (OPI) Nos. 138432/79 and 138433/79 and *Research Disclosure, No.* 18452. The advantage of such a layer is that it permits a wide tolerance for the processing temperature, because it assures the necessary image density at low temperatures and provides less stained highlight protions (i.e., it has low $D_{min}$ value) at high temperatures.

The term "positive image" as used herein means an image whose density (after development) decreases with the increase in the amount of imagewise exposure applied to the photosensitive material, and an emulsion that provides a silver positive image immediately upon one development after exposure is referred to as a direct reversal emulsion. The term "negative image" means an image whose density (after development) increases with the increase in the amount of imagewise exposure, and an emulsion that provides a silver negative image upon one development is referred to as a negative emulsion.

Examples of the support suitable for use in the photosensitive material of this invention include glass, paper and other film bases made of polyacrylic acid ester, polystyrene, polycarbonate, polyethylene terephthalate and cellulose acetate.

This invention is hereunder described in greater detail by the following examples which are given here for illustrative purposes only and are by no means intended to limit the scope of the invention.

EXAMPLE 1

A transparent polyethylene terephthalate film base was coated with an image receiving layer as a first layer containing 3.0 g/m² of poly(3- or 4-tri-n-hexylammoniummethyl)styrene chloride and 2.5 g/m² of gelatin, a light reflecting layer as a second layer containing 20 g/m² of titanium white and 2.5 g/m² of gelatin, and a backing layer as a third layer containing 2.0 g/m² of carbon black and 2.0 g/m² of gelatin. The third layer was overlaid with the following layers, in the order listed, to provide a diffusion transfer photosensitive sheet IA.

Fourth layer: a color material layer containing 0.56 g/m² of a cyan dye releasing redox compound and 1.5 g/m² of gelatin;

Fifth layer: a red-sensitive emulsion layer containing an internal latent image forming silver bromide reversal emulsion of core-shell structure (mono-disperse regular octahedral grains having a size of about 1 micron) which is optically sensitized as red-sensitive and which has incorporated therein 1-[4-(2-formylhydrazino)phenyl]-3-phenylthiourea as a nucleus forming agent, said emulsion being coated to give 1.2 g/m² of Ag, 0.06 g/m² of potassium salt of 2-sulfo-5-n-pentadecylhydroquinone, and 1.5 g/m² of gelatin;

Sixth layer: an intermediate layer of this invention that was prepared as follows: a hot solution comprising 50 g of 2,5-di-tert-pentadecylhydroquinone, 25 g of tricyclohexyl phosphate and 30 cc of ethyl acetate was mixed under vigorous mechanical agitation with 500 cc of a hot aqueous solution containing 40 g of gelatin and 2.0 g of sodium dodecylbenzenesulfonate to make an emulsion. To the emulsion, 45 g of a surface latent image forming silver iodobromide emulsion (3.0 mol% iodide, polydisperse grains having an average size of 0.7 micron) that was optically sensitized as red-sensitive and which contained 3.5 g of Ag and 3.0 g of gelatin was added, and then an aqueous solution of sodium salt of 4-hydroxy-6-methyl-1,3,3a,7-tetrazaindene was added as a stabilizer to prepare a coating solution. The coating solution was applied to provide a coating that contained 0.070 g/m² of Ag, 1.0 g/m² of 2,5-di-tert-pentadecylhydroquinone and 0.86 g/m² of gelatin;

Seventh layer: a spacer layer that contained 0.4 g/m² of gelatin;

Eighth layer: a color material layer that contained 0.65 g/m² of a magenta dye releasing redox compound and 1.2 g/m² of gelatin;

Ninth layer: a green-sensitive emulsion layer containing an internal latent image forming silver bromide reversal emulsion of core-shell structure (regular octahedral grains having a size of about 1.0 micron) which was optically sensitized as green-sensitive and which had incorporated therein a nucleus forming agent identical with what was used in the fifth layer, said emulsion being coated to give 1.3 g/m² of Ag, 0.07 g/m² of potassium salt of 2-sulfo-5-n-pentadecylhydroquinone, and 1.2 g/m² of gelatin;

Tenth layer: an intermediate layer of this invention that was prepared as follows: 100 g of a surface latent image forming silver iodobromide negative emulsion (3.0 mol% iodide, polydisperse grains having an average size of 0.7 micron) containing 7.1 g of Ag and 6.1 g of gelatin and which was optically sensitized as green-sensitive was added to an emulsion of 2,5-di-tert-pentadecylhydroquinone emulsion which was the same as used in the sixth layer, and then an aqueous solution of sodium salt of 1-phenyl-5-mercaptotetrazole was added as an antifoggant to prepare a coating solution. The coating solution was applied to provide a coating that contained 0.141 g/m$^2$ of Ag, 1.0 g/m$^2$ of 2,5-di-tert-pentadecylhydroquinone and 0.92 g/m$^2$ of gelatin;

Eleventh layer: a spacer layer that contained 0.4 g/m$^2$ of gelatin;

Twelfth layer: a color material layer that contained 0.75 g/m$^2$ of a yellow dye releasing redox compound and 1.4 g/m$^2$ of gelatin;

Thirteenth layer: a blue-sensitive emulsion layer containing an internal latent image forming silver bromide reversal emulsion of core-shell structure (monodisperse, regular octahedral grains having a size of 1.2 microns) which was optically sensitized as blue-sensitive and which had incorporated therein a nucleus forming agent the same as what was used in the fifth layer and sodium salt of 4-hydroxy-6-methyl-1,3,3a,7-tetrazaindene, said emulsion being coated to give 1.5 g/m$^2$ of Ag, 0.08 g/m$^2$ of potassium salt of 2-sulfo-5-n-pentadecylhydroquinone, and 1.5 g/m$^2$ of gelatin; and Fourteenth layer: a protective layer that contained 0.10 g/m$^2$ of 2,5-di-tert-pentadecylhydroquinone and 1.3 g/m$^2$ of gelatin.

These layers were hardened with 1,3-bis(vinylsulfonyl)-2-propanol.

The optical sensitizers used to sensitize the direct reversal emulsions and negative emulsions are identified below:

Red-Sensitive:

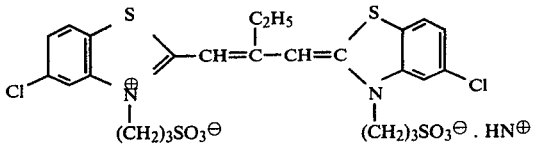

Green-Sensitive: The following two were used.

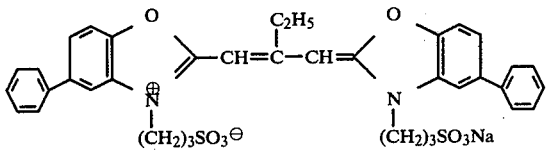

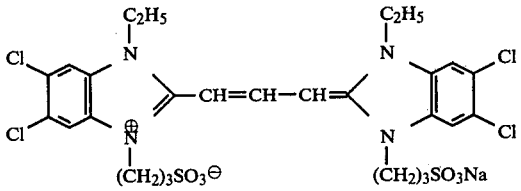

Blue-Sensitive:

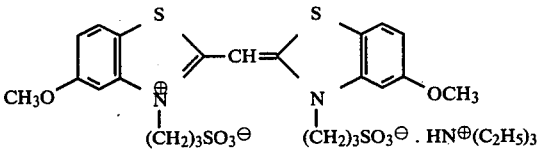

The dye releasing redox compounds employed are identified below:

Cyan

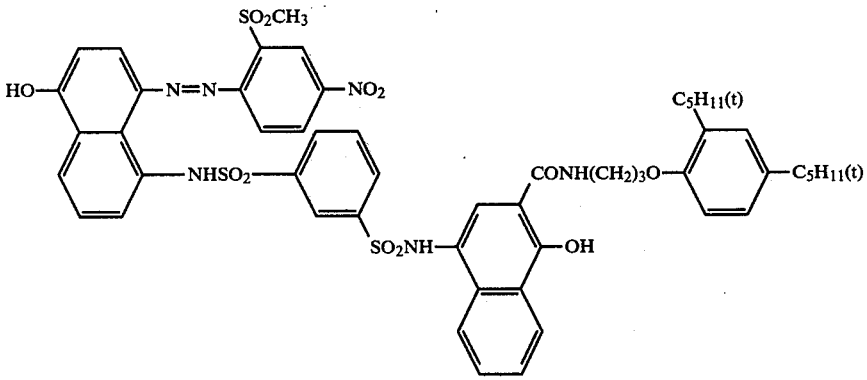

Magenta

-continued

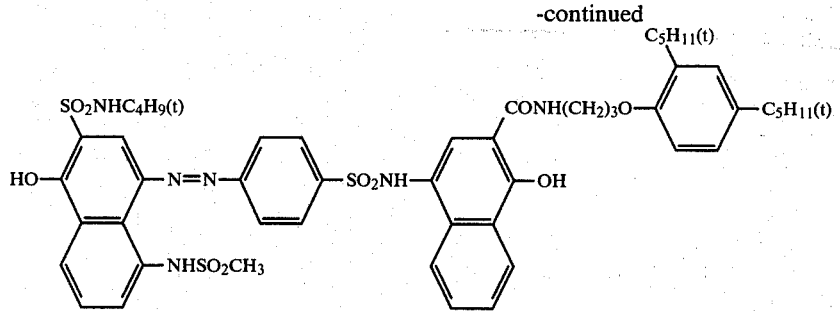

yellow

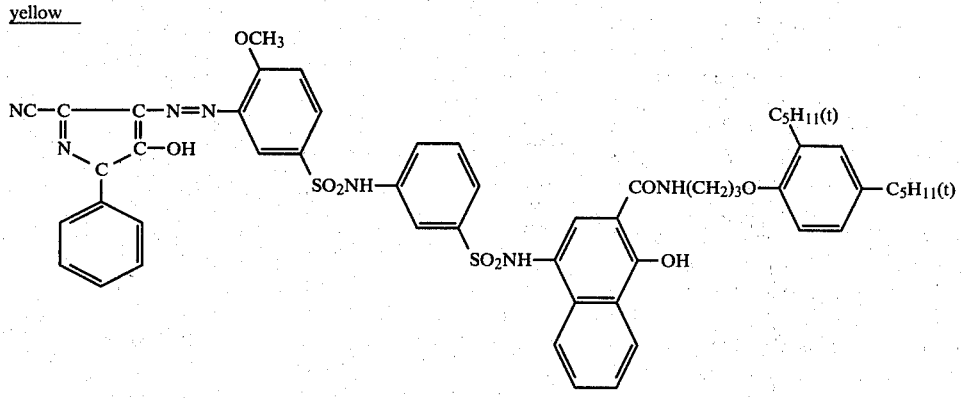

These dye releasing redox compounds were synthesized according to U.S. Pat. Nos. 4,053,312, 3,929,760, 3,932,380 or 3,309,199.

A transparent polyethylene terephthalate film base was coated sequentially with the following layers to prepare a distribution sheet:

First layer: a polymer acid layer wherein 20 g/m$^2$ of poly(n-butyl acrylate-co-acrylic acid-co-sodium acrylate) (weight ratio=30:65:5) was hardened with 1,4-bis(2,3-epoxypropoxy)butane;

Second layer: a layer containing 3.0 g/m$^2$ of cellulose acetate (degree of acetylation: 54), 0.3 g/m$^2$ of poly(-vinylmethylether-co-maleic anhydride) and 0.10 g/m$^2$ of a development inhibitor precursor, i.e., 1-phenyl-5-[(2-cyano-2-methylethyl)thio]tetrazole; and Third layer: a temperature compensation timing layer which was prepared by applying a latex of poly(styrene-co-butyl acrylate-co-acrylic acid) (weight ratio=52:42:6) (described in German Patent Application (OLS) No. 2,754,514) in an amount of 3.0 g/m$^2$ of polymer, followed by drying the coating at high temperature.

Separately from the preparation of the sensitive sheet and the distribution sheet, a viscous developer of the formulation indicated below was prepared:

| Viscous Developer | |
|---|---|
| Sodium carboxymethyl cellulose | 60 g |
| 5-Methyl-1,2,3-benzotriazole | 3.5 g |
| Sodium sulfite | 1.0 g |
| 4-Methyl-4-hydroxymethyl-1-phenyl-3-pyrazolidinone | 13 g |
| Methyl hydroquinone | 0.2 g |
| Benzyl alcohol | 1.0 g |
| Potassium hydroxide | 56 g |
| Carbon black | 150 g |
| Water | 720 cc |

After subjecting the photosensitive sheet to sensitometric, stepwise color separating exposure, the sheet was superimposed on the distribution sheet with the 14th (protective) layer facing the 3rd (timing) layer, and the developer was distributed between the two sheets to provide a developer thickness of 80 microns. A positive image with separated colors was found to form gradually. Such processing was performed at 15° C., 25° C. and 35° C., and after the processed sheets were left to stand for 3 hours at the respective temperatures, the reflection density at the gray scale area was measured.

For comparison, a control photosensitive sheet IB was prepared by the method of preparing the photosensitive sheet IA, except for the following two points, and the resulting control sheet was subjected to a sensitometric test in the same manner as described above.

(1) Sixth layer: an intermediate layer containing no negative emulsion and stabilizer but which contained gelatin instead of negative emulsion, i.e., a layer that contained 1.0 g/m$^2$ of 2,5-di-tert-pentadecylhydroquinone and 0.86 g/m$^2$ of gelatin; and (2) Tenth layer: an intermediate layer containing no negative emulsion and anti-foggant but which contained gelatin instead of negative emulsion, i.e., a layer that contained 1.0 g/m$^2$ of 2,5-di-tert-pentadecylhydroquinone and 0.92 g/m$^2$ of gelatin.

The results of sensitometric tests conducted with the two photosensitive sheets IA and IB are set forth in Table 1 below.

TABLE 1

| Photosensitive Sheet | Processing Temp. | Maximum Density ($D_{max}$) B | G | R | Minimum Density ($D_{min}$) B | G | R | Relative Sensitivity (G) |
|---|---|---|---|---|---|---|---|---|
| IA | 15° C. | 1.77 | 2.05 | 2.14 | 0.23 | 0.25 | 0.33 | 120 |
| (This | 25° C. | 1.82 | 2.10 | 2.18 | 0.23 | 0.27 | 0.34 | 100 |
| invention) | 35° C. | 1.85 | 2.12 | 2.18 | 0.25 | 0.27 | 0.36 | 90 |
| IB | 15° C. | 1.75 | 2.03 | 2.14 | 0.24 | 0.25 | 0.33 | 120 |
| (Con- | 25° C. | 1.82 | 2.07 | 2.16 | 0.24 | 0.25 | 0.34 | 110 |

TABLE 1-continued

| Photosensitive Sheet | Processing Temp. | Maximum Density ($D_{max}$) B | G | R | Minimum Density ($D_{min}$) B | G | R | Relative Sensitivity (G) |
|---|---|---|---|---|---|---|---|---|
| trol) | 35° C. | 1.85 | 2.10 | 2.18 | 0.25 | 0.26 | 0.34 | 100 |

The data shows that both photosensitive sheets exhibit almost the same performance over a wide temperature range and that in particular, they assure low minimum density at a higher temperature (e.g., 35° C.).

Figure 3:
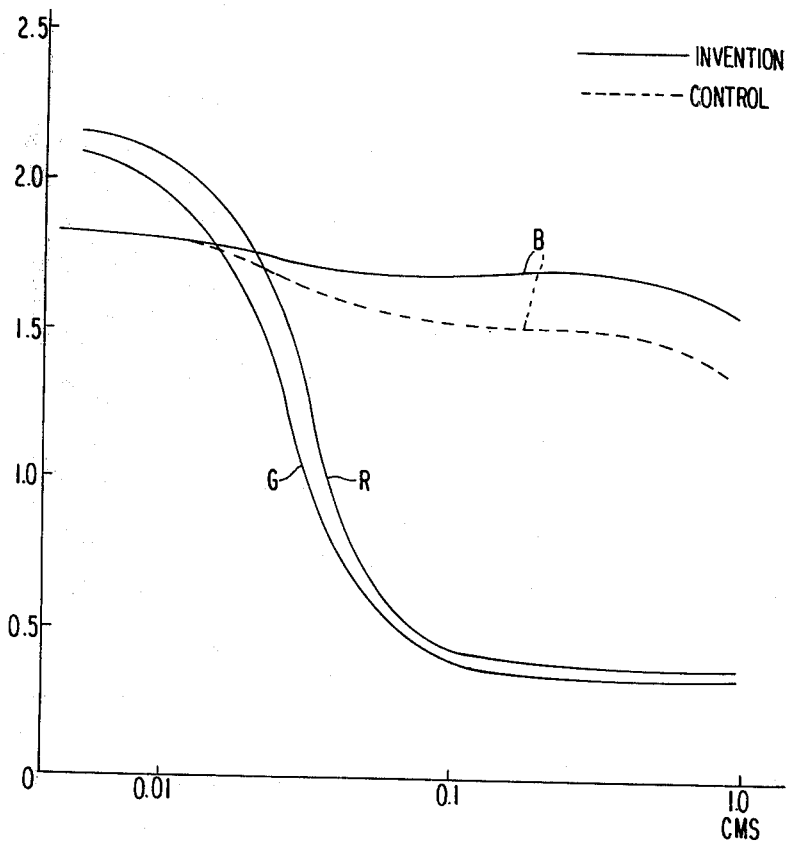
FIG. 3 to FIG. 5 are graphs showing characteristic curves.
Figure 4:
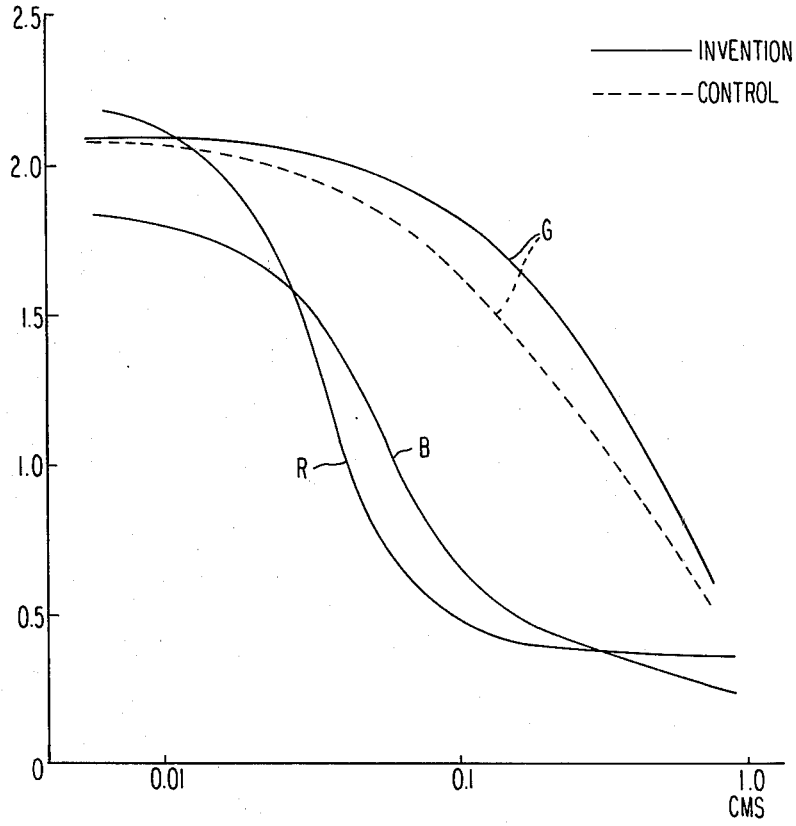
Figure 5:
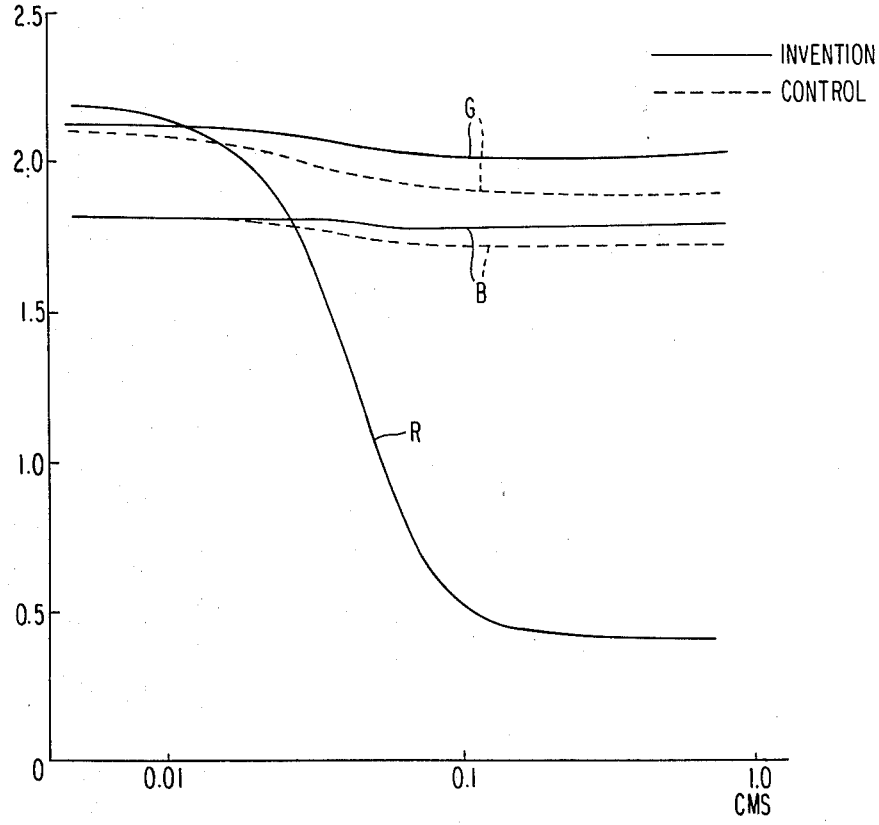

The sheets were exposed to monochromatic or dichromatic lights such as yellow, magenta, or red light that changed their illuminance stepwise. The measurements of the optical densities of the thus-processed areas are shown in FIGS. 3 to 5. FIG. 3 represents the case of exposure to white light through a yellow filter, FIG. 4 represents the case of exposure to white light through a magenta filter, and FIG. 5 the case of exposure to white light through a red filter. In the figures, B, G and R represent the densities of the blue-, green-, red-sensitive layers, respectively. The vertical axis represents the optical density, and the horizontal axis represents the logarithm of exposure (to white light). The solid line represents the case of the photosensitive material of this invention, and the broken line the case of the control photosensitive material.

In spite of constant exposure to blue light, the color of the yellow portion of the control photosensitive sheet IB containing only a ballasted hydroquinone derivative in the intermediate layer became pale (i.e., the blue density decreased—indicated by the dotted line) as the exposure to green and red lights increased. In contrast, the photosensitive sheet IA of this invention containing not only a ballasted hydroquinone derivative, but also a negative emulsion, retained the desired level of blue density (solid line) at the yellow portion irrespective of the exposure to green and red lights. The same is true with the magenta and red portions. Therefore, the photosensitive material of this invention was demonstrated to be capable of achieving reproduction of sharp colors of high saturation.

EXPERIMENT 1

To determine the effect of a bromide and an iodide on the development of the reversal emulsions employed in Example 1, a photographic film of the formulation indicated below was processed with three liquid developers of the formulations indicated below one of which was a control, another contained a bromide, and the last contained an iodide, and the amount of developed silver was measured.

Photographic film: A cellulose acetate film base was coated sequentially with a color material layer, an emulsion layer and a protective layer identical with what were used in Example 1, and the resulting film was hardened with sodium salt of 4,6-cichloro-2-hydroxy-s-triazine.

| Photographic Film No. | 1st Layer Color Material Layer | 2nd Layer Reversal Emulsion Layer | 3rd Layer Protective Layer | Color Sensitivity of Emulsion Layer |
|---|---|---|---|---|
| | (No. of layers of Example 1) | | | |
| 1 | 4 | 5 | 14 | red-sensitive |
| 2 | 8 | 9 | 14 | green-sensitive |
| 3 | 12 | 13 | 14 | blue-sensitive |

Processing Solutions:

| Components | No. of Processing Solution 1 (control) | 3 | 2 |
|---|---|---|---|
| Sodium salt of carboxymethyl cellulose | 60 g | 60 g | 60 g |
| Acidic sodium sulfite | 1.0 g | 1.0 g | 1.0 g |
| 5-Methylbenzotriazole | 3.5 g | 3.5 g | 3.5 g |
| 4-Methyl-4-hydroxymethyl-1-phenyl-3-pyrazolidinone | 13 g | 13 g | 13 g |
| Methyl hydroquinone | 0.2 g | 0.2 g | 0.2 g |
| Potassium bromide | — | 0.80 g | — |
| Potassium iodide | — | — | 40 mg |
| Potassium hydroxide | 56 g | 56 g | 56 g |
| Water | 82 cc | 82 cc | 82 cc |

After the photographic film was exposed to sensitometric white light that changed the illuminance stepwise, the protective layer was covered with a polyester sheet and the processing solutions were distributed between the two sheets to give a solution thickness of about 80 microns. After standing for 3 minutes at 25° C., the cover sheet was removed and the film was processed with an acidic hardening/fixing solution for 5 minutes, and then washed with water. The amounts of developed silver as determined by the fluorescent X-ray method were as follows:

TABLE 2

Effect of Halides on Development

| Photographic Film No. | Processing Solution No. | Developed Silver (g/m²) $D_{max}$ area | $D_{min}$ area |
|---|---|---|---|
| 1 | 1 | 0.54 | 0.097 |
| 1 | 2 | 0.65 | 0.102 |
| 1 | 3 | 0.57 | 0.097 |
| 2 | 1 | 0.59 | 0.088 |
| 2 | 2 | 0.71 | 0.096 |
| 2 | 3 | 0.75 | 0.100 |
| 3 | 1 | 0.68 | 0.115 |
| 3 | 2 | 0.81 | 0.125 |
| 3 | 3 | 0.77 | 0.117 |

The data shows that both bromide and iodide ions present in a developer accelerate the development of the three reversal emulsions used, and that the development of the negative emulsion in the intermediate layer cannot inhibit the development of the adjacent reversal emulsions used in this experiment.

EXAMPLE 2

A polyethylene terephthalate film base containing a small amount of fine particles of titanium dioxide was coated sequentially with the following layers to prepare a photosensitive sheet IIA.

First layer: an image receiving layer containing 3.0 g/m² of poly(3- or 4-tri-n-hexylammoniummethyl)styrene as a mordant and 2.5 g/m² of gelatin;

Second layer: a light reflecting layer containing 18 g/m² of rutile-type titanium dioxide surface-treated with aluminum oxide, zinc oxide and silica, and 2.5 g/m² of gelatin;

Third layer: a light-shielding layer containing 1.5 g/m$^2$ of carbon black and 1.5 g/m$^2$ of gelatin;

Fourth layer: a color material layer containing 0.42 g/m$^2$ of a cyan dye releasing redox compound, 0.01 g/m$^2$ of 2,5-di-sec-dodecylhydroquinone and 0.6 g/m$^2$ of gelatin;

Fifth layer: a red-sensitive emulsion layer containing a red-sensitive internal latent image forming silver iodobromide reversal emulsion of core-shell structure (0.2 mol% iodide, monodisperse regular octahedral grains having a size of 1.2 microns) which has incorporated therein 1-[4-(2-formylhydrazino)-phenyl]-3-phenylthiourea as a nucleus forming agent, said emulsion being coated to give 1.0 g/m$^2$ of Ag, 0.10 g/m$^2$ of potassium salt of 2-sulfo-5-n-pentadecylhydroquinone, and 1.2 g/m$^2$ of gelatin;

Sixth layer: an intermediate layer containing 0.63 g/m$^2$ of 2,5-di-sec-dodecylhydroquinone, 0.4 g/m$^2$ of poly(N-vinylpyrrolidone-co-vinyl acetate) (weight ratio=85:15), a red-sensitive surface latent image forming silver iodobromide negative emulsion (5.5 mol% iodide, polydisperse grains having an average size of 0.6 micron), said emulsion being coated to give 0.092 g/m$^2$ of Ag, and 0.5 g/m$^2$ of gelatin;

Seventh layer: a spacer layer composed of 0.3 g/m$^2$ of gelatin;

Eighth layer: a color material layer containing 0.24 g/m$^2$ of magenta dye releasing redox compound (A) and 0.11 g/m$^2$ of magenta dye releasing redox compound (B), 0.01 g/m$^2$ of 2,5-di-sec-dodecylhydroquinone and 0.40 g/m$^2$ of gelatin;

Ninth layer: a green-sensitive emulsion layer containing a green-sensitive internal latent image forming silver iodobromide reversal emulsion of core-shell structure (0.2 mol% iodide, monodisperse regular octahedral grains having a size of 1.2 microns) which has incorporated therein a nucleus forming agent identical with what was employed in the 5th layer, said emulsion being coated to give 1.0 g/m$^2$ of Ag, 0.10 g/m$^2$ of potassium salt of 2-sulfo-5-n-pentadecylhydroquinone, and 1.2 g/m$^2$ of gelatin;

Tenth layer: an intermediate layer containing 0.63 g/m$^2$ of 2,5-di-sec-dodecylhydroquinone, 0.4 g/m$^2$ of copoly(N-vinylpyrrolidone-vinyl acetate) (weight ratio=85:15), a green-sensitive surface latent image forming silver iodobromide negative emulsion (5.5 mol% iodide, polydisperse grains having an average size of 0.6 micron), said emulsion being coated to give 0.153 g/m$^2$ of Ag, and 0.55 g/m$^2$ of gelatin;

Eleventh layer: a yellow filter layer containing 0.12 g/m$^2$ of a yellow filter dye and 0.5 g/m$^2$ of gelatin;

Twelfth layer: a color material layer containing 0.45 g/m$^2$ of a yellow dye releasing redox compound, 0.01 g/m$^2$ of 2,5-di-sec-dodecylhydroquinone and 0.52 g/m$^2$ of gelatin;

Thirteenth layer: a blue-sensitive emulsion layer containing an optically sensitized internal latent image forming silver bromide reversal emulsion of core-shell structure (monodisperse regular octahedral grains having a size of 1.3 microns) which has incorporated therein a nucleus forming agent identical with what was employed in the 5th layer, said emulsion being coated to give 1.1 g/m$^2$ of Ag, 0.10 g/m$^2$ of potassium salt of 2-sulfo-5-n-pentadecylhydroquinone, and 1.3 g/m$^2$ of gelatin; and Fourteenth layer: a protective layer containing 0.10 g/m$^2$ of 2,5-di-sec-dodecylhydroquinone and 1.3 g/m$^2$ of gelatin.

These gelatin-containing layers were hardened with 1,2-bis(vinylsulfonylacetamido)ethane. The direct reversal emulsions and negative emulsions used were sensitized with optical sensitizers identical to those that were used in Example 1.

The following dye releasing redox compounds were used, synthesized in accordance with the disclosure in Japanese Patent Application No. 91187/79 (corresponding to U.S. Ser. No. 170,261, filed on July 18, 1980).

Cyan

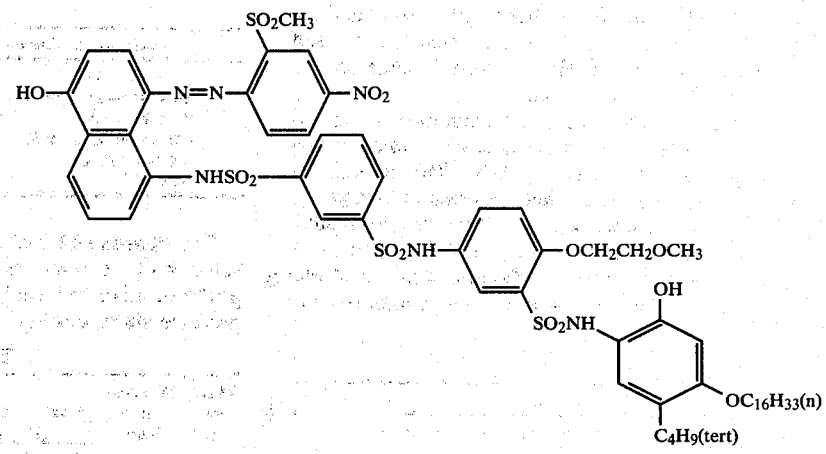

Magenta (A)

-continued

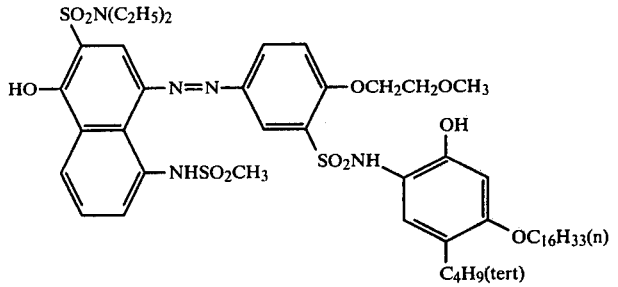

Magenta (B)

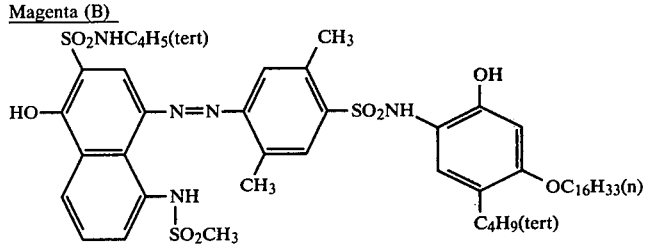

Yellow

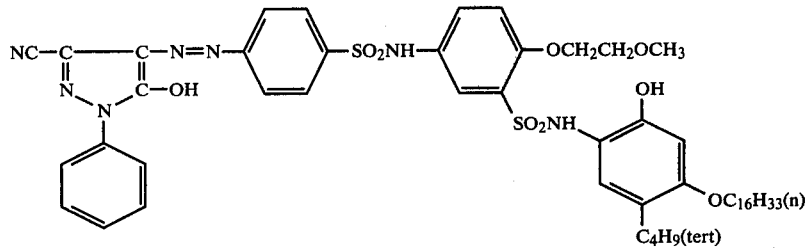

The yellow filter dye used is identified below.

-continued

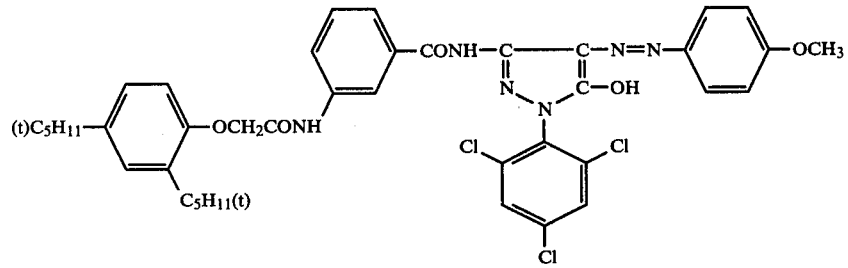

A control photosensitive sheet IIB was prepared, which was identical with IIA except that the 6th and 10th (intermediate) layers did not contain negative silver iodobromide emulsion grains.

A processing solution of the formulation indicated below was distributed in a thickness of 80 microns between the photosensitive sheet IIA (or IIB) and a distribution sheet identical with what was made in Example 1. A positive color image was found to form gradually. Such processing was carried out at 15° C., 25° C. and 35° C. after exposure, and the reflection densities at the gray scale areas were measured. The results are set forth in Table 3 below.

| Formulation of Processing Solution | |
|---|---|
| Sodium salt of carboxymethyl cellulose | 60 g |
| 5-Methyl-1,2,3-benzotriazole | 3.5 g |
| Sodium sulfite | 1.0 g |
| 4-Methyl-4-hydroxymethyl-1-p-tolyl-3-pyrazolidinone | 7.5 g |
| t-Butyl hydroquinone | 0.3 g |
| Benzyl alcohol | 1.7 g |
| Potassium hydroxide | 47 g |
| Carbon black | 150 g |
| Water | 730 cc |

The densities at the color separated areas were measured, and the results are shown in Table 4 below. The photosensitive material of this invention was found to produce sharp colors having high saturation.

TABLE 3

| Photosensitive Sheet | Processing Temp. (°C.) | Maximum Density ($D_{max}$) B | G | R | Minimum Density ($D_{min}$) B | G | R | Relative Sensitivity (G) |
|---|---|---|---|---|---|---|---|---|
| IIA | 15 | 1.95 | 2.00 | 2.15 | 0.23 | 0.23 | 0.30 | 90 |

TABLE 3-continued

| Photosensitive Sheet | Processing Temp. (°C.) | Maximum Density ($D_{max}$) B | G | R | Minimum Density ($D_{min}$) B | G | R | Relative Sensitivity (G) |
|---|---|---|---|---|---|---|---|---|
| (This invention) | 25 | 1.95 | 2.05 | 2.15 | 0.23 | 0.23 | 0.32 | 100 |
| | 35 | 1.85 | 2.05 | 2.10 | 0.25 | 0.24 | 0.34 | 100 |
| IIB (Control) | 15 | 1.90 | 2.00 | 2.10 | 0.23 | 0.23 | 0.31 | 100 |
| | 25 | 1.90 | 2.00 | 2.10 | 0.23 | 0.23 | 0.32 | 110 |
| | 35 | 1.80 | 2.05 | 2.05 | 0.24 | 0.23 | 0.32 | 110 |

TABLE 4

| Area Subjected to Separating Exposure | Photosensitive Element | Response to Colored Light (exposure to white light through colored filter) Low Exposure Area* B | G | R | High Exposure Area** B | G | R |
|---|---|---|---|---|---|---|---|
| Yellow | IIA | 1.94 | 2.07 | 2.18 | 1.83 | 0.32 | 0.37 |
| | IIB | 1.90 | 2.03 | 2.12 | 1.67 | 0.32 | 0.36 |
| Magenta | IIA | 1.93 | 2.07 | 2.15 | 0.48 | 1.61 | 0.39 |
| | IIB | 1.90 | 2.05 | 2.10 | 0.46 | 1.38 | 0.39 |
| Red | IIA | 1.95 | 2.05 | 2.17 | 1.90 | 1.96 | 0.39 |
| | IIB | 1.90 | 2.05 | 2.12 | 1.82 | 1.75 | 0.39 |

*Black area: exposed to less than 0.01 CMS of white light
**Color separated area: 0.3 CMS

EXAMPLE 3

A transparent triacetyl cellulose film base was coated sequentially with the following layers to prepare a photosensitive sheet IIIA.

First layer: a blue-sensitive emulsion layer containing an internal latent image forming silver bromide reversal emulsion of core-shell structure (monodisperse regular octahedral grains having a size of 1.3 microns) which contains 1-formyl-2-{4-[3-(3-phenylthioureido)benzamido]phenyl}hydrazide as a nucleus forming agent and which is optically sensitized as in Example 1, said emulsion being coated to give 1.55 g/m$^2$ of Ag, 0.13 g/m$^2$ of 2-sulfo-5-sec-octadecylhydroquinone, and 1.85 g/m$^2$ of gelatin;

Second layer: a yellow color material layer containing 0.85 g/m$^2$ of a yellow dye releasing redox compound, 0.02 g/m$^2$ of 2,5-di-tert-decylhydroquinone and 1.0 g/m$^2$ of gelatin;

Third layer: a yellow filter layer containing yellow colloid silver (0.05 g/m$^2$ of Ag) and 0.4 g/m$^2$ of gelatin;

Fourth layer: an intermediate layer containing 0.57 g/m$^2$ of 2,5-di-tert-decylhydroquinone, 0.28 g/m$^2$ of tricyclohexyl phosphate, 0.11 g Ag/m$^2$ of a green-sensitive surface latent image forming silver iodobromide negative emulsion (3.0 mol% iodide, polydisperse grains having an average size of 0.5 micron), and 0.80 g/m$^2$ of gelatin;

Fifth layer: a green-sensitive emulsion layer containing 1.25 g Ag/m$^2$ of an internal latent image forming silver bromide reversal emulsion of core-shell structure (monodisperse regular octahedral grains having a size of 1.0 micron) which contains a nucleus forming agent identical with what is used in the first layer and which is optically sensitized as in Example 1, 0.2 g/m$^2$ of 2-sulfo-5-sec-octadecylhydroquinone, and 1.5 g/m$^2$ of gelatin;

Sixth layer: a magenta color material layer containing 0.55 g/m$^2$ of a magenta dye releasing redox compound, 0.01 g/m$^2$ of 2,5-di-tert-decylhydroquinone, and 0.63 g/m$^2$ of gelatin;

Seventh layer: a spacer layer composed of 0.4 g/m$^2$ of gelatin;

Eighth layer: an intermediate layer containing 0.57 g/m$^2$ of 2,5-di-tert-decylhydroquinone, 0.28 g/m$^2$ of tricyclohexyl phosphate, 0.11 g Ag/m$^2$ of a red-sensitive surface latent image forming silver iodobromide negative emulsion (3.0 mol% iodide, polydisperse grains having an average size of 0.5 micron) and 0.8 g/m$^2$ of gelatin;

Ninth layer: a red-sensitive emulsion layer containing 1.30 g Ag/m$^2$ of an internal latent image forming silver bromide reversal emulsion of core-shell structure (monodisperse regular octahedral grains having a size of 1.0 micron) which contains a nucleus forming agent identical with what is used in the first layer and which is optically sensitized as in Example 1, 0.02 g/m$^2$ of 2-sulfo-5-sec-octadecylhydroquinone, and 1.55 g/m$^2$ of gelatin;

Tenth layer: a cyan color material layer containing 0.65 g/m$^2$ of a cyan dye releasing redox compound, 0.01 g/m$^2$ of 2,5-di-tert-decylhydroquinone, and 1.0 g/m$^2$ of gelatin;

Eleventh layer: a protective layer containing 0.6 g/m$^2$ of gelatin; and

Twelfth layer: a light-shielding layer containing 1.0 g/m$^2$ of carbon black and 1.3 g/m$^2$ of gelatin.

The first to tenth layers were hardened with the N-(4-chloro-6-oxy-2-s-triazinyl)gelatin prepared according to U.S. Pat. No. 3,362,827, and the eleventh and twelfth layers were not hardened.

The dye releasing redox compounds used are identified below.

Cyan

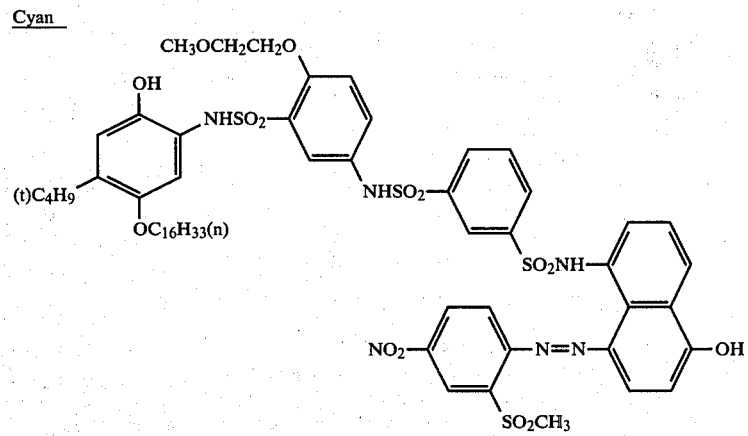

-continued

Magenta

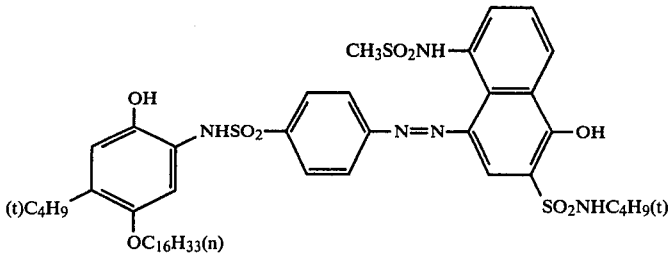

Yellow

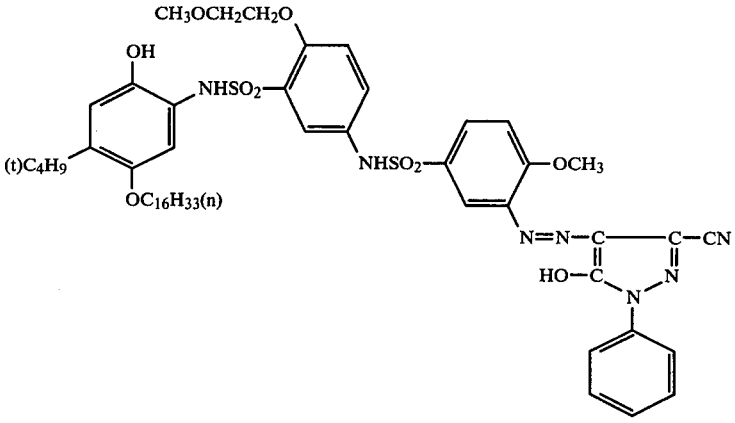

Separately from the photosensitive sheet, a transparent polyethylene terephthalate film base was sequentially coated with the following layers to prepare an image-receiving/distribution sheet.

First layer: an acid polymer layer containing 24 g/m$^2$ of a half ester of poly(vinylmethylether-co-maleic anhydride) (molar ratio=1:1) and n-butanol and 0.15 g/m$^2$ of 1-phenyl-5-[(2-cyano-2-methylethyl)-thio]-tetrazole;

Second layer: a temperature compensating timing layer identical with the distribution sheet of Example 1;

Third layer: an image-receiving layer containing 3.0 g/m$^2$ of poly(3- or 4-tri-n-hexylammoniummethyl)styrene as a mordant and 2.5 g/m$^2$ of gelatin; and Fourth layer: a protective layer composed of 1.3 g/m$^2$ of gelatin.

The third and fourth layers were hardened with formaldehyde.

A viscous developer of the formulation indicated below was placed in a pressure-rupturable pod.

| Viscous Developer | |
|---|---|
| Hydroxyethyl cellulose | 20 g |
| 5-Methylbenzotriazole | 3.5 g |
| Sodium sulfite | 1.0 g |
| 4-Methyl-4-hydroxymethyl-1-phenyl-3-pyrazolidinone | 13 g |
| t-Butyl hydroquinone | 0.3 g |
| Benzyl alcohol | 1.0 g |
| Sodium hydroxide | 40 g |
| Titanium white | 260 g |
| Water | 660 cc |

The above-described photosensitive sheet, image-receiving/distribution sheet and pod were assembled into a film unit of the type described in U.S. Pat. No. 3,993,486. The photosensitive sheet was subjected to sensitometric stepwise color separating exposure through the film base, and thereafter, the processing solution was distributed in a thickness of 80 microns between the photosensitive sheet and the image-receiving/distribution sheet, with the 12th layer of the photosensitive sheet facing the 4th layer of the distribution sheet. A positive image with separated colors was found to form gradually. Ten days after the processing, the image-receiving/distribution sheet was peeled as a color print from the photosensitive sheet together with the layer of processing solution. The photosensitive sheet was desilvered with a bleach-fix solution as described in British Pat. No. 1,479,739, and freed from the light-shielding layer with warm water. As a result, a color negative with separated colors that can be used in reproduction of color prints was obtained.

EXAMPLE 4

The photosensitive materials IA, IIA and IIIA of this invention that were prepared in Examples 1, 2 and 3, respectively, and the control photosensitive materials IB, IIB and IIIB having intermediate layers free of negative emulsions were subjected to exposure in the following three steps.

Step 1: exposure to white light having sensitometric stepwise illuminance

Step 2: uniform exposure to blue light

Step 3: uniform exposure to green light

Photosensitive materials IA and IB, IIA and IIB, and IIIA and IIIB were subjected to the development described in Examples 1, 2 and 3, respectively, to thereby provide monochromatic prints having cyan stepwise optical densities. The red and green densities of these prints were measured, and the purity of the resulting cyan dye was evaluated in terms of the green density for a red density of 1.0.

TABLE 5

| Sample No. | Source | Measured Values Red Density | Green Density | Auxiliary Absorption of Green Light by Cyan Image at Red Density of 1.50* |
|---|---|---|---|---|
| IA | This Invention | 1.00 | 0.33 | 0.28 |
| IB | Control | 1.00 | 0.43 | 0.28 |
| IIA | This Invention | 1.00 | 0.31 | 0.28 |
| IIB | Control | 1.00 | 0.39 | 0.28 |
| IIIA | This Invention | 1.00 | 0.33 | 0.28 |
| IIIB | Control | 1.00 | 0.44 | 0.28 |

Absorption Characteristics (reflection density) of Cyan Dye Image

*Absorption of green light by cyan image in the absence of dye deterioration, as measured with a single emulsion layer free of intermediate layer.

The above data shows that the photosensitive materials of this invention provide cyan images that have low green absorption values which are closer to the theoretical value than the control photosensitive materials. Analysis of the cyan dyes in the controls showed that a substantial portion of the nitro group in the 2-methylsulfonyl-4-nitrophenylazo group in the dyes was reduced to a hydroxyamino or amino group, and this fact relates to the high green light absorption by the cyan dye.

While the invention has been described in detail and with reference to specific embodiments thereof, it will be apparent to one skilled in the art that various changes and modifications can be made therein without departing from the spirit and scope thereof.

What is claimed is:

1. A color photographic material suitable for processing with an alkaline solution in the presence of a developing agent comprising a support and, in sequence, the following five layers:

(1) a first emulsion layer containing an internal latent image forming direct reversal silver halide emulsion that is selectively sensitive to light in a first spectral region;

(2) a first color material layer containing a ballasted dye releasing redox compound that provides a dye image that selectively absorbs light in the first spectral region;

(3) an intermediate layer containing a ballasted reducing agent capable of capturing an oxidized developing agent or electron transfer agent;

(4) a second emulsion layer containing an internal latent image forming direct reversal silver halide emulsion that is selectively sensitive to light in a second spectral region; and (5) a second color material layer containing a ballasted dye releasing redox compound that provides a dye image that selectively absorbs light in the second spectral region;

wherein the improvement comprises uniformly incorporating a surface latent image forming negative silver halide emulsion that is sensitive to light in the second spectral region in the intermediate layer (3) so as to obtain uniform oxidation of reducing agent that is formed in the intermediate layer (3) as a result of development of the second emulsion layer.

2. A color photographic material as in claim 1 wherein layer (1) is the closest of said five layers to the side of the material from which imagewise exposure is intended to be made.

3. A color photographic material according to claim 1 or 2 wherein the negative interimage effect due to the amount of dye released from the first color material layer (2) caused by the development of the second emulsion layer (4) is lessened by making the distribution of the reducing agent uniform.

4. A color photographic material according to claim 1 or 2 wherein the deterioration of photographically useful components due to strong reducing activity of the reducing agent is lessened by decreasing the amount of residual reducing agent in the intermediate layer (3) after development.

5. A color photographic material according to claim 1 or 2 comprising a support, and, in sequence, the following layers:

(1) a blue-sensitive internal latent image forming direct reversal silver halide emulsion layer;

(2) a layer containing a yellow dye releasing redox compound;

(3) a first intermediate layer containing a ballasted reducing agent capable of capturing an oxidized developing agent or electron transfer agent;

(4) a green-sensitive internal latent image forming direct reversal silver halide emulsion layer;

(5) a layer containing a magenta dye releasing redox compound;

(6) a second intermediate layer containing a ballasted reducing agent that captures an oxidized developing agent or electron transfer agent;

(7) a red-sensitive internal latent image forming direct reversal silver halide emulsion layer; and (8) a layer containing a cyan dye releasing redox compound;

wherein at least one of said first and second intermediate layers contains a negative emulsion.

6. A color photographic material according to claim 5 wherein said first intermediate layer contains a green-sensitive negative emulsion.

7. A color photographic material according to claim 5 wherein said second intermediate layer contains a red-sensitive emulsion.

8. A color photographic material according to claim 5 wherein said first intermediate layer contains a green-sensitive negative emulsion and said second intermediate layer contains a red-sensitive negative emulsion.

9. A color photographic material according to claim 1 or 2 wherein the intermediate layer (3) is not isolated from the second emulsion layer to avoid redox reaction.

10. A color photographic material according to claim 5 which contains a dye releasing redox compound that releases at least one image dye that is capable of being reductively deteriorated with the reducing agents in the intermediate layers (3) and (6) under developing conditions.

11. A color photographic material according to claim 10 wherein the image dye capable of being reductively deteriorated is an azo dye substituted by a nitro group.

12. A color photographic material according to claim 10 wherein the azo dye is a 4-(p-nitrophenylazo)-1-naphthol dye.

13. A diffusion transfer color photographic film unit comprising the photographic material of claim 1 or 2, combined with an image-receiving layer.

14. A diffusion transfer color photographic film unit comprising the photographic material of claim 5 combined with an image-receiving layer.

15. A diffusion transfer color photographic film unit comprising the photographic material of claim 8 combined with an image-receiving layer.

16. A diffusion transfer color photographic film unit according to claim 13 wherein the (a) photographic material, (b) image-receiving layer and (c) means for distributing a processing solution over a photosensitive layer are combined.

17. A diffusion transfer color photographic film unit according to claim 14 wherein the (a) photographic material, (b) image-receiving layer and (c) means for distributing a processing solution over a photosensitive layer are combined.

18. A diffusion transfer color photographic film unit according to claim 15 wherein the (a) photographic material, (b) image-receiving layer and (c) means for distributing a processing solution over a photosensitive layer are combined.

19. A color photographic material according to claim 1 wherein a spacer layer of a hydrophilic polymer is formed between the intermediate layer (3) and the first color material layer (2).

20. A color photographic material according to claim 1 or 2 wherein the negative interimage effect is lessened by incorporating in the intermediate layer (3)

from about 0.15 to 0.5 redox equivalent of a reducing agent per equivalent of silver halide in the second emulsion layer (4), and a negative silver halide emulsion containing silver in an amount from about 0.02 to about 0.2 times greater than the amount of silver halide in said second emulsion layer.

21. A color photographic material according to claim 1 or 2 wherein the negative interimage effect is lessened by incorporating in the intermediate layer (3)

from about 0.2 to 0.4 equivalent of a reducing agent per equivalent of silver halide in second emulsion layer (4), and a negative silver halide emulsion containing silver in an amount from 0.05 to 0.15 times greater than the amount of silver halide in said second emulsion layer.

22. A color photographic material according to claim 1 or 2 wherein a deteriorating effect of the reducing agent in the intermediate layer (3) on photographically useful components is lessened by incorporating in the intermediate layer a negative silver halide emulsion containing from about 0.04 to 0.8 equivalents of silver per equivalent of said reducing agent.

23. A color photographic material according to claim 1 or 2 wherein a deteriorating effect of the reducing agent in the intermediate layer (3) on photographically useful components is lessened by incorporating in the intermediate layer a negative silver halide emulsion containing from 0.1 to 0.6 equivalent of silver per equivalent of said reducing agent.

24. A color photographic material according to claim 1 or 2 wherein the intermediate layer (3) contains as a ballasted reducing agent a hydroquinone derivative substituted by two alkyl groups having a total of at least 16 carbon atoms.

25. A diffusion transfer color photographic film unit comprising the photographic material of claim 3, combined with an image-receiving layer.

26. A diffusion transfer color photographic film unit comprising the photographic material of claim 4, combined with an image-receiving layer.

27. A diffusion transfer color-photographic film unit according to claim 25 wherein the (a) photographic material, (b) image-receiving layer and (c) means for distributing a processing solution over a photosensitive layer are combined.

28. A diffusion transfer color photographic film unit according to claim 26 wherein the (a) photographic material, (b) image-receiving layer and (c) means for distributing a processing solution over a photosensitive layer are combined.

* * * * *